US011035022B2

(12) United States Patent
Kubo et al.

(10) Patent No.: US 11,035,022 B2
(45) Date of Patent: Jun. 15, 2021

(54) METAL SHEET, METHOD OF PRODUCING METAL SHEET, METHOD OF PRODUCING MOLDED PRODUCT OF METAL SHEET, AND MOLDED PRODUCT OF METAL SHEET

(71) Applicant: NIPPON STEEL CORPORATION, Tokyo (JP)

(72) Inventors: Masahiro Kubo, Tokyo (JP); Yoshiaki Nakazawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/044,106

(22) PCT Filed: Apr. 2, 2019

(86) PCT No.: PCT/JP2019/014693
§ 371 (c)(1),
(2) Date: Sep. 30, 2020

(87) PCT Pub. No.: WO2019/194201
PCT Pub. Date: Oct. 10, 2019

(65) Prior Publication Data

US 2021/0017623 A1 Jan. 21, 2021

(30) Foreign Application Priority Data

Apr. 2, 2018 (JP) ..... JP2018-071080

(51) Int. Cl.

| | |
|---|---|
| ***C22C 38/12*** | (2006.01) |
| ***C22C 38/14*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 9/48*** | (2006.01) |
| ***B21D 22/20*** | (2006.01) |
| ***C21D 9/46*** | (2006.01) |
| ***B21B 1/22*** | (2006.01) |
| ***C21D 6/00*** | (2006.01) |
| ***C21D 8/02*** | (2006.01) |
| ***C22C 38/08*** | (2006.01) |
| ***C22C 38/16*** | (2006.01) |
| ***C22C 38/60*** | (2006.01) |

(52) U.S. Cl.

CPC ..... *C21D 9/46* (2013.01); *B21B 1/22* (2013.01); *C21D 6/005* (2013.01); *C21D 6/008* (2013.01); *C21D 8/0205* (2013.01); *C21D 8/0236* (2013.01); *C21D 8/0273* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/60* (2013.01); *B21B 2001/221* (2013.01); *C21D 2211/005* (2013.01)

(58) Field of Classification Search

CPC B21D 22/20; C21D 2211/005; C21D 8/0236; C21D 9/48; C22C 38/00; C22C 38/001; C22C 38/002; C22C 38/02; C22C 38/04; C22C 38/06; C22C 38/12; C22C 38/14

See application file for complete search history.

(56) References Cited

U.S. PATENT DOCUMENTS

| | | | | |
|---|---|---|---|---|
| 2016/0221080 | A1* | 8/2016 | Higashi ..... | B24D 18/0009 |
| 2018/0361456 | A1 | 12/2018 | Kubo et al. | |
| 2020/0188981 | A1 | 6/2020 | Kubo et al. | |

FOREIGN PATENT DOCUMENTS

| | | | |
|---|---|---|---|
| JP | 11-007038 | A | 1/1999 |
| JP | 5683193 | B2 | 3/2015 |

(Continued)

OTHER PUBLICATIONS

International Search Report issued in PCT/JP2019/014693, dated Jul. 9, 2019 (Form PCT/ISA/210).

Notice of Reasons for Refusal for corresponding Japanese Application 2019-566374, dated Feb. 18, 2020.

R. Becker; Effects of strain localization on surface roughening during sheet forming; Acta Materialia, 1998; vol. 46, No. 4; pp. 1385-1401.

Suzuki Seiichi, the example of analysis of the rolling texture by the EBSD method, a light metal, Japan, general incorporated foundation Japan Institute of Light Metals, Nov. 30, 2016; vol. [66th]; No. 11; pp. 566-573.

(Continued)

*Primary Examiner* — Jenny R Wu

(74) *Attorney, Agent, or Firm* — Birch, Stewart, Kolasch & Birch, LLP

(57) ABSTRACT

Provided are a metal sheet, a method of producing a metal sheet, a method of producing a molded product of a metal sheet, and a molded product of a metal sheet, in which occurrence of surface roughness is inhibited. Provided are a metal sheet satisfying conditions (a1), (b1) or (c1) at the surface and a method for producing the metal sheet. Also provided are a method for producing a molded product of a metal sheet using the metal sheet, and a molded product of the metal sheet. (a1) The area fraction of crystal grains having a crystal orientation divergent by 20° or more from a (111) plane and by 20° or more from a (001) plane is from 0.25 to 0.35, and the average crystal grain size is less than 16 μm. (b1) The area fraction of crystal grains having a crystal orientation divergent by 20° or more from a (111) plane and by 20° or more from a (001) plane is from 0.15 to 0.30, and the average crystal grain size is 16 μm or more. (c1) The area fraction of crystal grains with a Taylor Factor value from 3.0 to 3.4, when assuming plane strain tensile deformation in the transverse direction, is from 0.18 to 0.40.

9 Claims, 7 Drawing Sheets

(56) References Cited

FOREIGN PATENT DOCUMENTS

| | | | |
|---|---|---|---|
| JP | 6156613 | B1 | 7/2017 |
| JP | 2018-80386 | A | 5/2018 |
| KR | 10-2011-0046653 | A | 5/2011 |
| WO | WO 2017/098983 | A1 | 6/2017 |

OTHER PUBLICATIONS

Written Opinion of the International Searching Authority for PCT/JP2019/014693 (PCT/ISA/237) dated Jun. 26, 2019.

* cited by examiner

[Fig. 1]
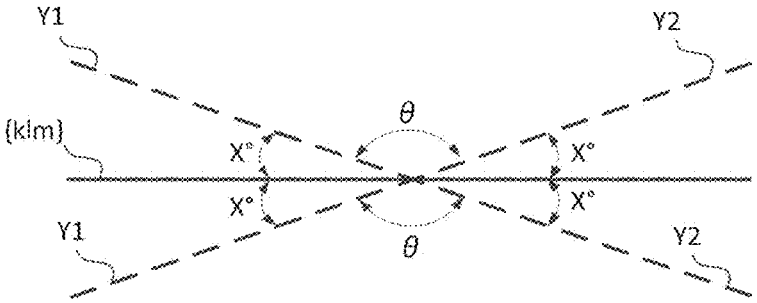
[Fig. 2]
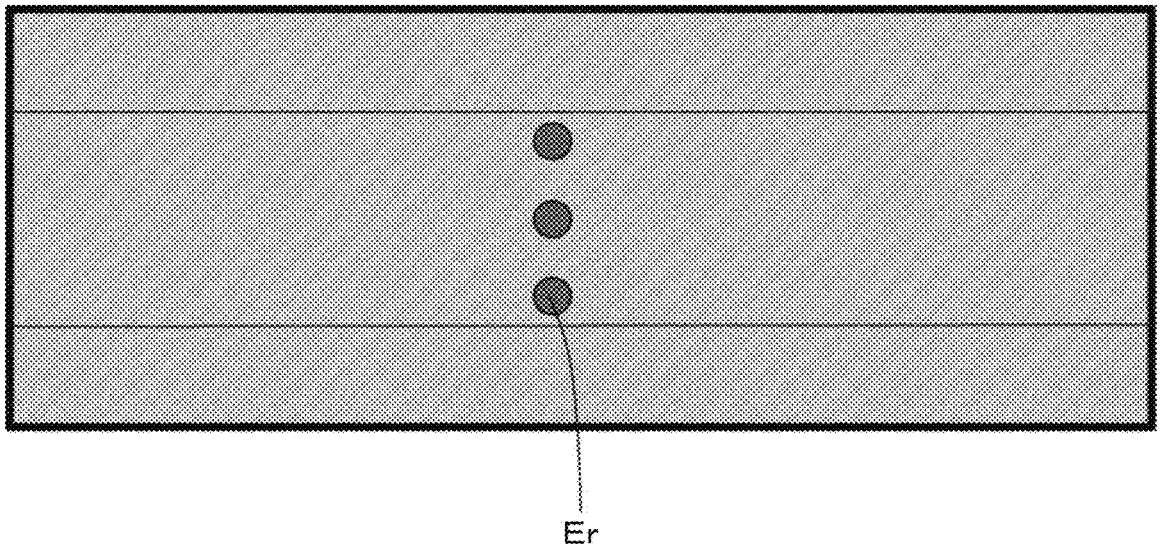
[Fig. 3]
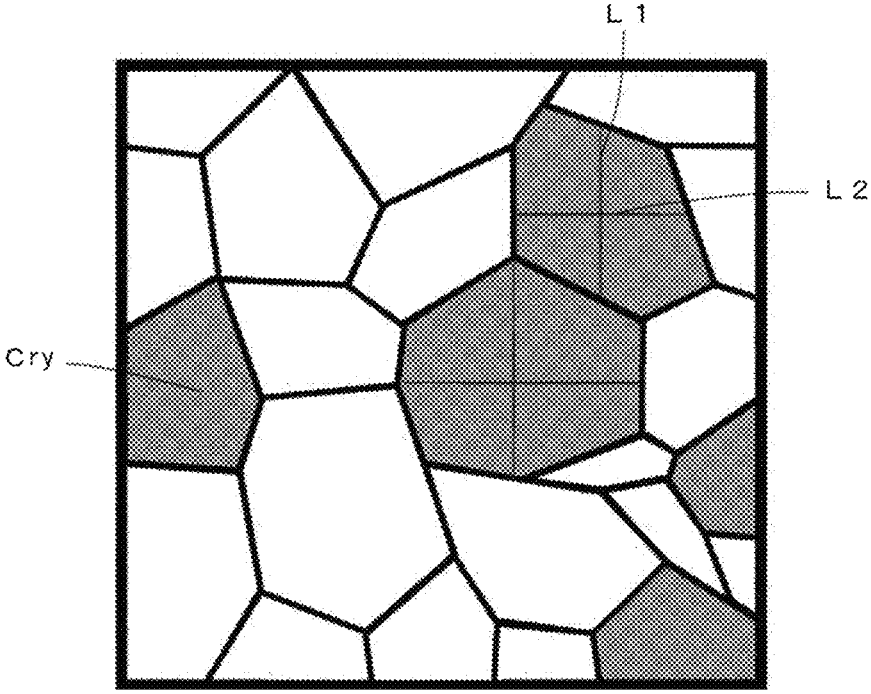

[Fig. 4A]
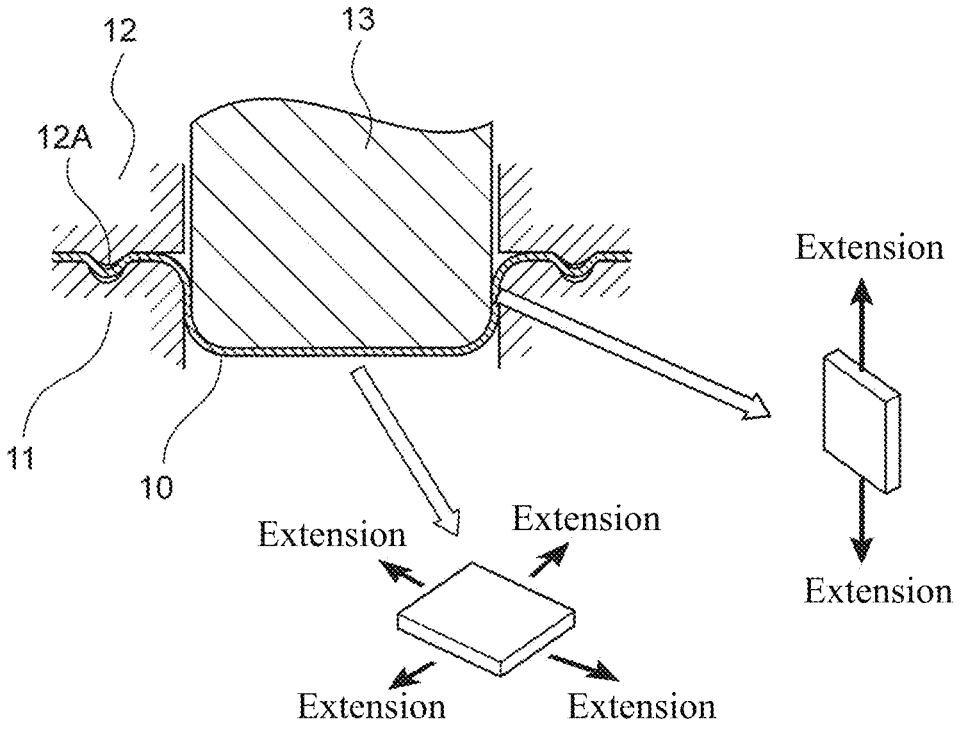

[Fig. 4B]
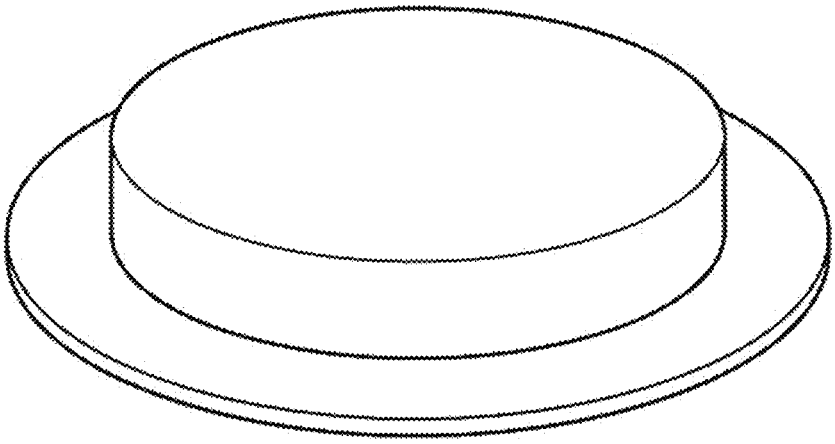

[Fig. 5A]
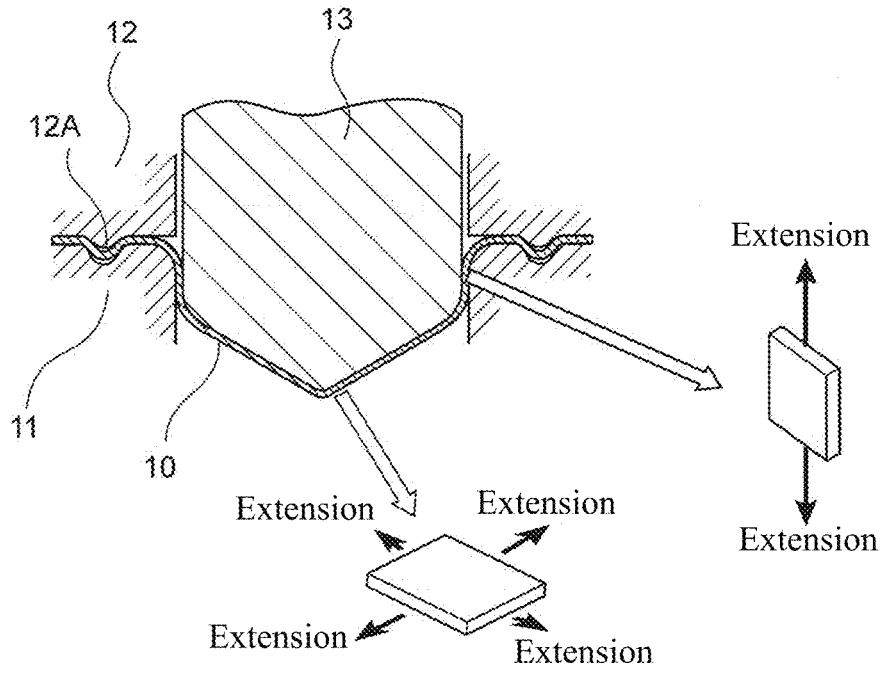
[Fig. 5B]
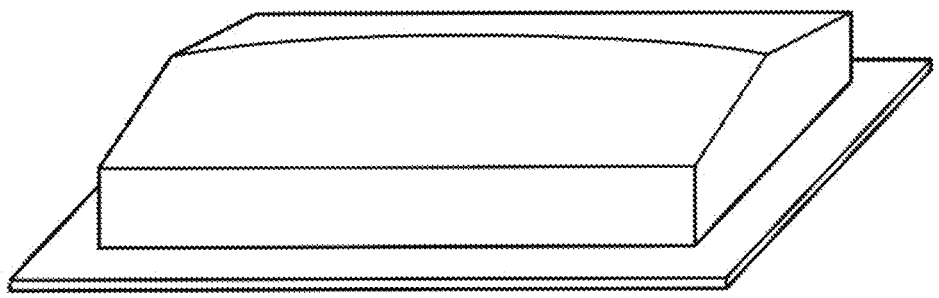

[Fig. 6]
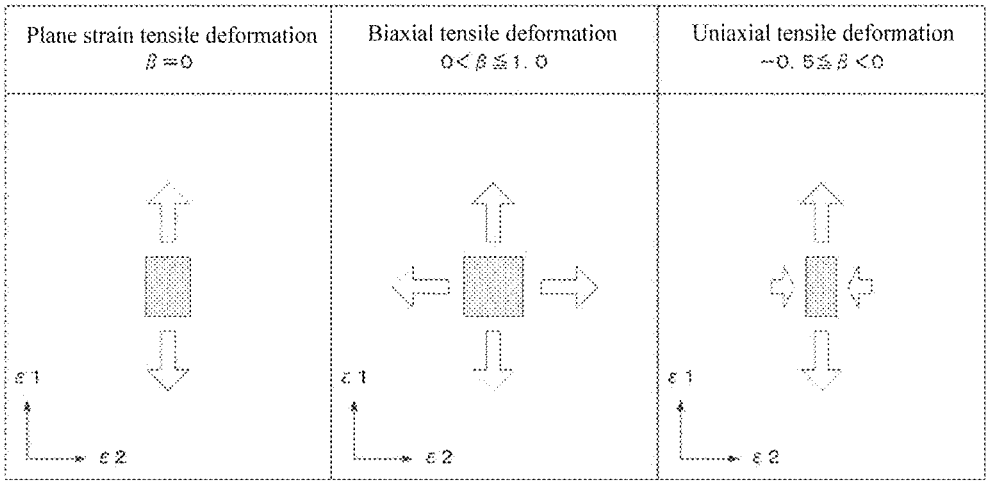

[Fig. 7]
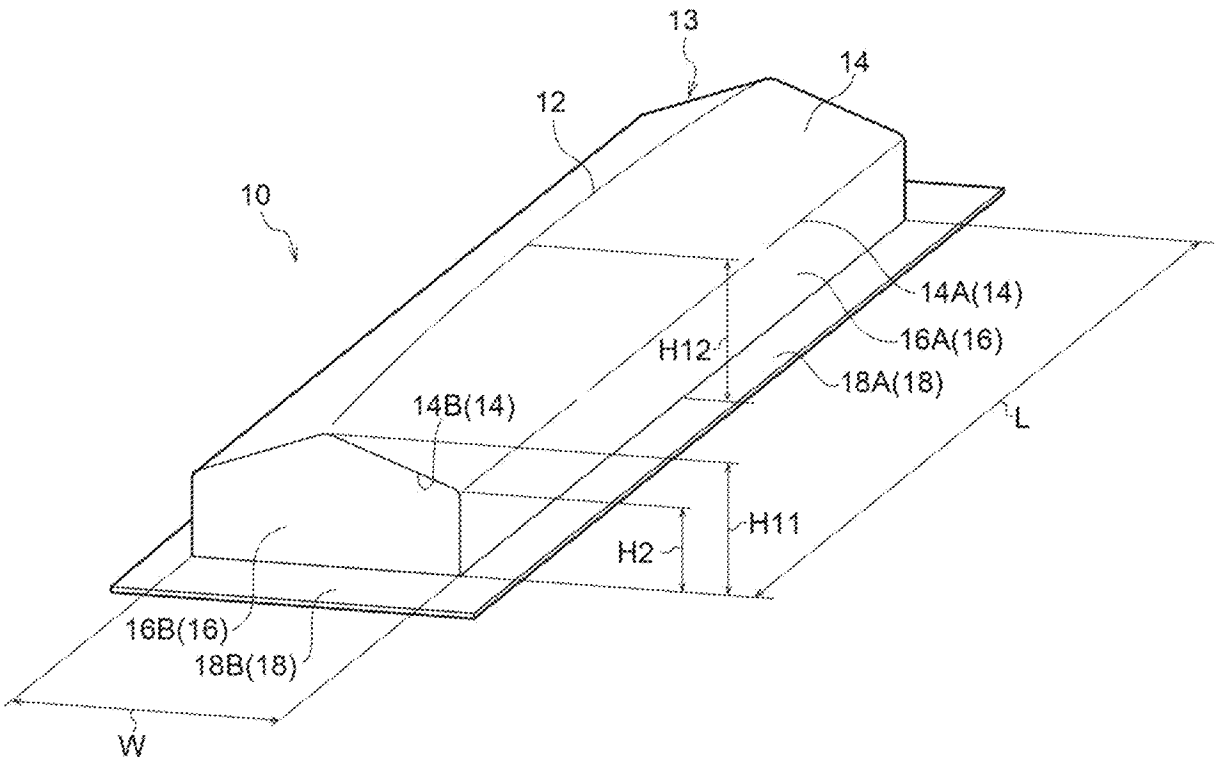

[Fig. 8]
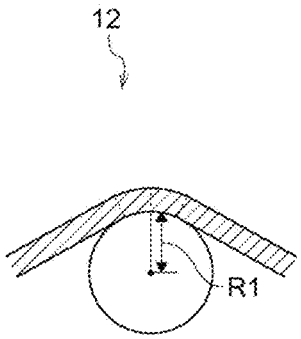

METAL SHEET, METHOD OF PRODUCING METAL SHEET, METHOD OF PRODUCING MOLDED PRODUCT OF METAL SHEET, AND MOLDED PRODUCT OF METAL SHEET

TECHNICAL FIELD

The present disclosure relates to a metal sheet, a method of producing a metal sheet, a method of producing a molded product of a metal sheet, and a molded product of a metal sheet.

BACKGROUND ART

In recent years, in the fields of automobiles, aircraft, marine vessels, construction materials, home electric appliances, and the like, design is becoming more prioritized in order to respond to users' needs. This tends to make especially the shapes of the exterior parts complicated. In order to mold a metal sheet into a molded product having a complicated shape, it is necessary to generate strain in a metal sheet. However, as a strain (hereinafter, also referred to as machining amount) increases, fine protrusions and recesses are likely to be formed on the surface of a molded product, resulting in abnormal surface roughness. This is problematic because excellent exterior appearance may be impaired.

For example, Patent Document 1 discloses that protrusions and recesses form a stripe pattern (ridging) in parallel to the rolling direction. Specifically, Patent Document 1 discloses the following. It is possible to obtain a rolled sheet of an aluminum alloy for molding, which has excellent ridging resistance by controlling an average Taylor factor determined when regarding that molding causes plane strain tensile deformation in the rolling width direction that is the main strain direction. An average Taylor factor that is calculated based on all crystal orientations present in crystal texture is strongly related to ridging resistance. Ridging resistance can be stably improved with certainty by controlling crystal texture such that the average Taylor factor value satisfies specific conditions.

Patent Document 2 discloses a method of producing a molded product, including: treating a metal sheet having a bcc structure and a surface that satisfies either of the following conditions (a) "an area fraction of crystal grains having a crystal orientation of 15° or less relative to a (001) plane parallel to the surface of the metal sheet is from 0.20 to 0.35" or (b) "the area fraction of crystal grains having a crystal orientation of 15° or less relative to a (001) plane parallel to the surface of the metal sheet is 0.45 or less, and an average crystal grain size thereof is 15 μm or less"; and molding the metal sheet to cause plane strain tensile deformation and biaxial tensile deformation and allowing at least a part of the metal sheet to have a sheet thickness decrease rate of from 10% to 30%:

Patent Document 1: Japanese Patent No. 5683193

Patent Document 2: Japanese Patent No. 6156613

SUMMARY OF INVENTION

Problems to be Solved by the Invention

However, Patent Document 1 merely discloses that ridging can be inhibited upon molding of a metal sheet in which uniaxial tensile deformation occurs in the rolling width direction as the main strain direction. In addition, molding such as deep drawing molding or overhang molding of a metal sheet, which may cause plane strain tensile deformation and biaxial tensile deformation, is not considered.

Meanwhile, in recent years, there is a demand to produce a molded product having a complicated shape even in the case of molding such as deep drawing molding or overhang molding, which may cause plane strain tensile deformation and biaxial tensile deformation of a metal sheet. However, when molding is conducted for a metal sheet at a large machining amount (a machining amount corresponding to a sheet thickness decrease rate of 10% or more for a metal sheet), protrusions and recesses are formed on the surface of a molded product, which results in abnormal surface roughness and impairment of excellent appearance. Similar problems are seen under also in the case of molding of a metal sheet in which plane strain tensile deformation exclusively occurs.

For the above reasons, for example, conventional automobile exterior sheet products are produced at machining amounts within a limited scope in which the amount of distortion of a product face corresponds to a sheet thickness decrease rate of less than 10% for a metal sheet. In other words, processing conditions are limited in order to avoid the occurrence of abnormal surface roughness. However, there is a demand for further complicated shapes of automobile exterior sheet products. A method that achieves a sheet thickness decrease rate of 10% or more for a metal sheet and inhibition of abnormal surface roughness in a well-balanced manner upon molding has been awaited.

The method of producing the molded product of Patent Document 2 also provides a molded product in which occurrence of surface roughness is inhibited. However, it is also desirable to use a technique that inhibits occurrence of surface roughness by using a different approach from the method of producing a molded product of Patent Document 2.

In consideration of the above, an object of the disclosure is to provide a metal sheet, a method of producing a metal sheet, and a method of producing a molded product of a metal sheet utilizing the metal sheet, by which a molded product in which surface roughness is inhibited can be obtained even by treating a metal sheet having a bcc structure, and by molding the metal sheet to cause plane strain tensile deformation and biaxial tensile deformation and causing at least a part of the metal sheet to have a sheet thickness decrease rate of from 10% to 30%.

Another object of one aspect of the disclosure is to provide a molded product of a metal sheet in which occurrence of surface roughness is inhibited, even in the case of a molded product of a metal sheet having a bcc structure, having a ridge line, and satisfying the following conditions (BD) and (BH).

In consideration of the above, another object of the disclosure is to provide a metal sheet, a method of producing a metal sheet, and a method of producing a molded product of a metal sheet utilizing the metal sheet, by which a molded product in which surface roughness is inhibited can be obtained even by treating a metal sheet having an fcc structure, and by molding the metal sheet to cause plane strain tensile deformation and biaxial tensile deformation and causing at least a part of the metal sheet to have a sheet thickness decrease rate of from 10% to 30%.

Another object of one aspect of the disclosure is to provide a molded product of a metal sheet in which occurrence of surface roughness is inhibited, even in the case of a molded product of a metal sheet having an fcc structure, having a ridge line, and satisfying the following conditions (FD) and (FH).

Means for Solving the Problems

The disclosure is summarized as follows.

<1>

A metal sheet having a bcc structure and satisfying the following condition (a1) or (b1) at a surface thereof:

(a1) an area fraction of crystal grains having a crystal orientation divergent by 20° or more from a (111) plane parallel to a surface of the metal sheet and by 20° or more from a (001) plane is from 0.25 to 0.35, and an average crystal grain size is less than 16 μm; or (b1) an area fraction of crystal grains having a crystal orientation divergent by 20° or more from a (111) plane parallel to a surface of the metal sheet and by 20° or more from a (001) plane is from 0.15 to 0.30, and an average crystal grain size is 16 μm or more.

<2>

A metal sheet having a bcc structure and satisfying the following condition (c1) at a surface thereof:

(c1) an area fraction of crystal grains with a Taylor Factor value from 3.0 to 3.4, when assuming plane strain tensile deformation in a transverse direction in a plane of the metal sheet, is from 0.18 to 0.40.

<3>

The metal sheet according to <1> or <2>, wherein the metal sheet is a steel sheet.

<4>

The metal sheet according to <3>, wherein the steel sheet is a ferrite-based steel sheet having a ferrite fraction of 50% or more of a metallic structure at a surface thereof.

<5>

The metal sheet according to <3> or <4>, wherein the steel sheet is a ferrite-based steel sheet having a chemical composition of:

C: from 0.0040% by mass to 0.0100% by mass;

Si: from 0% by mass to 1.0% by mass;

Mn: from 0.90% by mass to 2.00% by mass;

P: from 0.050% by mass to 0.200% by mass;

S: from 0% by mass to 0.010% by mass;

Al: from 0.00050% to 0.10% by mass;

N: from 0% by mass to 0.0040% by mass;

Ti: from 0.0010% by mass to 0.10% by mass;

Nb: from 0.0010% by mass to 0.10% by mass;

B: from 0% by mass to 0.003% by mass;

a total of one or more of Cu or Sn: from 0% by mass to 0.10% by mass;

a total of one or more of Ni, Ca, Mg, Y, As, Sb, Pb, or REM: from 0% by mass to 0.10% by mass; and a balance: Fe and impurities, wherein a value of F1 as defined in the following Formula (1) is from 0.5 to 1.0:

$$F1=(C/12+N/14+S/32)/(Ti/48+Nb/93). \quad \text{Formula (1)}$$

<6>

The metal sheet according to <5>, wherein the chemical composition of the steel sheet contains one or two or more of:

the total of one or more of Cu or Sn: from 0.002% by mass to 0.10% by mass; and the total of one or more of Ni, Ca, Mg, Y, As, Sb, Pb, or REM: from 0.005% by mass to 0.10% by mass.

<7>

A method of producing the metal sheet according to <5> or <6>, the method comprising:

cold-rolling a hot-rolled sheet with a draft of 70% or more to obtain a cold-rolled sheet; and annealing the cold-rolled sheet under conditions of an annealing temperature of a recrystallization temperature +25° C. or less, a temperature irregularity at the sheet surface of ±10° C. or less, and an annealing time of 100 seconds or less.

<8>

A method of producing a molded product of a metal sheet, the method comprising:

treating the metal sheet according to any one of claims 1 to 6;

molding the metal sheet to cause plane strain tensile deformation and biaxial tensile deformation; and causing at least a part of the metal sheet to have a sheet thickness decrease rate of from 10% to 30%.

<9>

A molded product of a metal sheet having a bcc structure and including a ridge line, the molded product satisfying the following conditions (BD) and (BH), and satisfying the following conditions (a2) or (b2) at a surface portion with a maximum sheet thickness:

(BD) when a maximum sheet thickness of the molded product is D1 and a minimum sheet thickness of the molded product is D2, $10 \leq (D1-D2)/D1 \times 100 \leq 30$;

(BH) when a maximum Vickers hardness of the molded product is H1, and a minimum Vickers hardness of the molded product is H2, $15 \leq (H1-H2)/H1 \times 100 \leq 40$;

(a2) an area fraction of crystal grains having a crystal orientation divergent by 20° or more from a (111) plane parallel to a surface of the molded product and by 20° or more from a (001) plane is from 0.25 to 0.35, and an average crystal grain size is less than 16 μm; and (b2) an area fraction of crystal grains having a crystal orientation divergent by 20° or more from a (111) plane parallel to a surface of the molded product and by 20° or more from a (001) plane is from 0.15 to 0.30, and an average crystal grain size is 16 μm or more.

<10>

A molded product of a metal sheet having a bcc structure and including a ridge line, the molded product satisfying the following conditions (BD) and (BH), and satisfying the following condition (c2) at a surface portion with a maximum sheet thickness:

(BD) when a maximum sheet thickness of the molded product is D1 and a minimum sheet thickness of the molded product is D2, $10 \leq (D1-D2)/D1 \times 100 \leq 30$;

(BH) when a maximum Vickers hardness of the molded product is H1, and a minimum Vickers hardness of the molded product is H2, $15 \leq (H1-H2)/H1 \times 100 \leq 40$; and (c2) an area fraction of crystal grains with a Taylor Factor value from 3.0 to 3.4, when assuming plane strain tensile deformation in a direction orthogonal to an extension direction of the ridge line at a minimum radius of curvature of a concave surface of the ridge line in a cross-section orthogonal to an extension direction of the ridge line, is from 0.18 to 0.35.

<11>

The molded product of a metal sheet according to <9> or <10>, wherein the metal sheet is a steel sheet.

<12>

The molded product of a metal sheet according to <11>, wherein the steel sheet is a ferrite-based steel sheet having a ferrite fraction of 50% or more of a metallic structure at a surface thereof.

<13>

The molded product of a metal sheet according to <11> or <12>, wherein the steel sheet is a ferrite-based steel sheet having a chemical composition of:

C: from 0.0040% by mass to 0.0100% by mass;

Si: from 0% by mass to 1.0% by mass;

Mn: from 0.90% by mass to 2.00% by mass;

P: from 0.050% by mass to 0.200% by mass;

S: from 0% by mass to 0.010% by mass;

Al: from 0.00050% to 0.10% by mass;

N: from 0% by mass to 0.0040% by mass;

Ti: from 0.0010% by mass to 0.10% by mass;

Nb: from 0.0010% by mass to 0.10% by mass;

B: from 0% by mass to 0.003% by mass;

a total of one or more of Cu or Sn: from 0% by mass to 0.10% by mass;

a total of one or more of Ni, Ca, Mg, As, Sb, Pb, or REM: from 0% by mass to 0.10% by mass; and a balance: Fe and impurities, wherein a value of F1 as defined in the following Formula (1) is from 0.5 to 1.0:

$$F1=(C/12+N/14+S/32)/(Ti/48+Nb/93). \quad \text{Formula (1)}$$

<14>

The molded product of a metal sheet according to <13>, wherein the chemical composition of the steel sheet contains one or more of:

the total of one or more of Cu or Sn: from 0.002% by mass to 0.10% by mass; and the total of one or two or more of Ni, Ca, Mg, As, Sb, Pb, or REM: from 0.005% by mass to 0.10% by mass.

<15>

A metal sheet having an fcc structure and satisfying the following condition (a1) or (b1) at a surface thereof:

(a1) an area fraction of crystal grains having a crystal orientation divergent by 20° or more from a (111) plane parallel to a surface of the metal sheet and by 20° or more from a (001) plane is from 0.25 to 0.35, and an average crystal grain size is less than 16 μm; or (b1) an area fraction of crystal grains having a crystal orientation divergent by 20° or more from a (111) plane parallel to a surface of the metal sheet and by 20° or more from a (001) plane is from 0.15 to 0.30, and an average crystal grain size is 16 μm or more.

<16>

A metal sheet having an fcc structure and satisfying the following condition (c1) at a surface thereof:

(c1) an area fraction of crystal grains with a Taylor Factor value from 3.0 to 3.4, when assuming plane strain tensile deformation in a transverse direction in a plane of a metal sheet, is from 0.18 to 0.40.

<17>

The metal sheet according to <15> or <16>, wherein the metal sheet is an austenitic stainless steel sheet.

<18>

The metal sheet according to <15> or <16>, wherein the metal sheet is an aluminum alloy sheet.

<19>

A method of producing a molded product of a metal sheet, the method comprising:

treating the metal sheet according to any one of claims 15 to 18;

molding the metal sheet to cause plane strain tensile deformation and biaxial tensile deformation; and causing at least a part of the metal sheet to have a sheet thickness decrease rate of from 5% to 30%.

<20>

A molded product of a metal sheet having an fcc structure and including a ridge line, the molded product satisfying the following conditions (FD) and (FH), and satisfying the following conditions (a2) or (b2) at a surface portion with a maximum sheet thickness:

(FD) when a maximum sheet thickness of the molded product is D1 and a minimum sheet thickness of the molded product is D2, $5 \leq (D1-D2)/D1 \times 100 \leq 30$;

(FH) when a maximum Vickers hardness of the molded product is H1, and a minimum Vickers hardness of the molded product is H2, $7 \leq (H1-H2)/H1 \times 100 \leq 40$;

(a2) an area fraction of crystal grains having a crystal orientation divergent by 20° or more from a (111) plane parallel to a surface of the molded product and by 20° or more from a (001) plane is from 0.25 to 0.35, and an average crystal grain size is less than 16 μm; and (b2) an area fraction of crystal grains having a crystal orientation divergent by 20° or more from a (111) plane parallel to a surface of the molded product and by 20° or more from a (001) plane is from 0.15 to 0.30, and an average crystal grain size is 16 μm or more.

<21>

A molded product of a metal sheet having an fcc structure and including a ridge line, the molded product satisfying the following conditions (FD) and (FH), and satisfying the following condition (c2) at a surface portion with a maximum sheet thickness:

(FD) when a maximum sheet thickness of the molded product is D1 and a minimum sheet thickness of the molded product is D2, $5 \leq (D1-D2)/D1 \times 100 \leq 30$;

(FH) when a maximum Vickers hardness of the molded product is H1, and a minimum Vickers hardness of the molded product is H2, $7 \leq (H1-H2)/H1 \times 100 \leq 40$; and (c2) an area fraction of crystal grains with a Taylor Factor value from 3.0 to 3.4, when assuming plane strain tensile deformation in a direction orthogonal to an extension direction of the ridge line at a minimum radius of curvature of a concave surface of the ridge line in a cross-section orthogonal to an extension direction of the ridge line, is from 0.18 to 0.35.

<22>

The molded product of a metal sheet according to <20> or <21>, wherein the metal sheet is an austenitic stainless steel sheet.

<23>

The molded product of a metal sheet according to <20> or <21>, wherein the metal sheet is an aluminum alloy sheet.

Effect of the Invention

According to one aspect of the disclosure, a metal sheet, a method of producing a metal sheet, and a method of producing a molded product of a metal sheet utilizing the metal sheet, by which a molded product in which surface roughness is inhibited can be obtained even by treating a metal sheet having a bcc structure, and by molding the metal sheet to cause plane strain tensile deformation and biaxial tensile deformation and causing at least a part of the metal sheet to have a sheet thickness decrease rate of from 10% to 30% can be provided.

According to another aspect of the disclosure, a molded product of a metal sheet in which occurrence of surface roughness is inhibited, even in the case of a molded product of a metal sheet having a bcc structure, having a ridge line, and satisfying the following conditions (BD) and (BH) can be provided.

According to another aspect of the disclosure, a metal sheet, a method of producing a metal, and a method of producing a molded product utilizing the metal sheet, by which a molded product in which surface roughness is inhibited can be obtained even by treating a metal sheet having an fcc structure, and by molding the metal sheet to cause plane strain tensile deformation and biaxial tensile deformation and causing at least a part of the metal sheet to have a sheet thickness decrease rate of from 10% to 30% can be provided.

According to another aspect of the disclosure, a molded product of a metal sheet in which occurrence of surface roughness is inhibited, even in the case of a molded product of a metal sheet having an fcc structure, having a ridge line, and satisfying the conditions (FD) and (FH) described below can be provided.

BRIEF DESCRIPTION OF DRAWINGS

FIG. 1 schematically explains the definition of the expression "crystal grains having a crystal orientation of X° or more from a (klm) plane."

FIG. 2 schematically illustrates an observational view of a metal sheet from the top to illustrate sites where the area fraction and average crystal grain size are to be measured.

FIG. 3 schematically illustrates a method of measuring the average crystal grain size of crystal grains.

FIG. 4A schematically illustrates one example of overhang molding.

FIG. 4B schematically illustrates one example of a molded product obtained by overhang molding illustrated in FIG. 4A.

FIG. 5A schematically illustrates one example of drawing overhang molding.

FIG. 5B schematically illustrates one example of a molded product obtained by drawing overhang molding illustrated in FIG. 5A.

FIG. 6 schematically explains plane strain tensile deformation, biaxial tensile deformation, and uniaxial tensile deformation.

FIG. 7 shows a schematic perspective view of an example of a molded product of a metal sheet according to first and second embodiments.

FIG. 8 shows a partial schematic cross-sectional view of an example of a ridge line of a molded product of a metal sheet according to first and second embodiments.

DESCRIPTION OF EMBODIMENTS

Hereinafter, some examples of embodiments of the disclosure are described in detail with reference to the drawings. Identical reference numerals are given to the same or corresponding portions and the description thereof will not be repeated in the drawings.

Herein, the "%" indication of the content of each element in the chemical composition means "% by mass".

A numerical range represented by "~" means a range including numerical values described before and after "~" as a lower limit and an upper limit.

When numeric values before and after "~" are followed by "more than" or "less than", the numeric range means the range that does not include these numbers as lower or upper limits.

The term "process" includes not only an independent step but also a step that is not clearly distinguishable from another step, provided that the intended purpose of the step is achieved.

The "extensional direction of a ridge line" means a direction in which a ridge line extends at a location of the ridge line in question when a design surface with the ridge line is viewed in plan. For example, the "extensional direction of a ridge line" at a location where an apex of the ridge line draws a straight line means a direction in which the straight line extends. On the other hand, the "extensional direction of a ridge line" at a location where an apex of the ridge line draws a curve means a direction in which a tangent to the curve at the location extends.

The term "design surface" refers to a surface of a molded product of a metal sheet that is exposed to the outside and can be aesthetic.

(Metal Sheet Having bcc Structure)

The metal sheet according to a first embodiment is a metal sheet satisfying the following condition (a1), (b1), or (c1) at a surface thereof:

(a1) the area fraction of crystal grains (hereinafter, also referred to as "crystal grain A") having a crystal orientation divergent by 20° or more from a (111) plane parallel to a surface of the metal sheet and by 20° or more from a (001) plane is from 0.25 to 0.35, and the average crystal grain size is less than 16 μm; or (b1) the area fraction of crystal grains (crystal grain A) having a crystal orientation divergent by 20° or more from a (111) plane parallel to a surface of the metal sheet and by 20° or more from a (001) plane is from 0.15 to 0.30, and the average crystal grain size is 16 μm or more;

(c1) the area fraction of crystal grains (hereinafter, also referred to as "crystal grain C") with a Taylor Factor value (hereinafter, also referred to as "TF value") from 3.0 to 3.4, when assuming plane strain tensile deformation in the transverse direction in a plane of the metal sheet, is from 0.18 to 0.40.

With the above-described configuration, the metal sheet according to the first embodiment can provide a molded product in which surface roughness is inhibited even by molding the metal sheet to cause plane strain tensile deformation and biaxial tensile deformation and causing at least a part of the metal sheet to have a sheet thickness decrease rate of from 10% to 30%. The metal sheet according to the first embodiment was discovered by the following findings.

In recent years, the correspondence between a metallic structure and mechanical properties of metal sheets has been studied. The inventors conducted the following studies.

Firstly, the relationship between crystal orientation of crystal grains and surface roughness in a multiaxial deformation field of plane strain tensile deformation was studied. As a result, the inventors obtained the following findings. The increase in surface roughness is greater in plane strain tensile deformation than in biaxial tensile deformation. In particular, the surface roughness of a metal sheet with a specific crystal texture, such as an IF steel plate, increases more in plane strain tensile deformation than in biaxial tensile deformation. The reason for this can be attributed to the large difference in strength between crystal grains depending on the mode of deformation. In other words, the degree of deformation between biaxial and plane strain tensile deformations is considered to be significantly different between crystal grains.

Therefore, the inventors focused on crystal grains with crystal orientations other than the (001) and (111) planes, in which the strength of crystal grains does not change significantly between biaxial and plane strain tensile deformations. The fraction of these crystal grains was then increased, and the difference in surface roughness development between isobiaxial and plane strain tensile deformation was verified, including in relation to the average crystal grain size.

As a result, the inventors obtained the following findings. Increasing the fraction of crystal grains with crystal orientations other than the (001) and (111) planes inhibits increase in surface roughness in plane strain tensile deformation, even when a metal sheet is formed at a large machining amount (machining amount that results in a sheet thickness decrease rate of 10% or more of a metal sheet). As a result, the degree of crystal grain deformation is reduced between isobiaxial and plane strain tensile deformations, and the difference in surface roughness development is reduced.

Specifically, the inventors made the following findings

In cases in which the average crystal grain size is 16 μm or less, when the area fraction of crystal grain A is from 0.25 to 0.35 (or when the condition (a1) is satisfied), or in cases in which the average crystal grain size is 16 μm or more, when the area fraction of crystal grain A is from 0.15 to 0.30 (or when the condition (b1) is satisfied), an increase in surface roughness in plane strain tensile deformation is inhibited even when the metal sheet is formed at a large machining amount. As a result, the degree of deformation of crystal grains is reduced between isobiaxial and plane strain tensile deformations, and the difference in surface roughness development is reduced.

In other words, when the condition (a1) or the condition (b1) is satisfied, surface roughness is inhibited even when plane strain tensile deformation and biaxial tensile deformation occur and at least a part of a metal sheet is subjected to molding that results in a thickness decrease rate of from 10% to 30%.

On the other hand, the inventors also conducted the following studies.

First, the inventors focused on a Taylor Factor value (TF value) when assuming plane strain tensile deformation of a metal sheet in the transverse direction. The TF value is an index indicating the magnitude of deformation resistance when any deformation of the crystal is assumed.

Then, the relationship between TF value and surface roughness was studied. As a result, the inventors obtained the following findings.

By controlling the fraction of crystal grain C whose TF value assuming plane strain tensile deformation of a metal sheet in the transverse direction is from 3.0 to 3.4, the increase in surface roughness in plane strain tensile deformation is inhibited even when a metal sheet is formed at a large machining amount. As a result, the degree of deformation of crystal grains is reduced between isobiaxial and plane strain tensile deformation, and the difference in surface roughness development is reduced. The reason for this is that the TF value assuming biaxial tensile deformation is mainly distributed from 3.0 to 3.4. By controlling the fraction of grain C, the distribution of the difference in deformation resistance between crystal grains is considered to be similar between isobiaxial and plane strain tensile deformation, and the difference in surface roughness development due to the deformation mode is considered to be reduced.

In other words, when the condition (c1) is satisfied, plane and biaxial tensile deformations occur, and occurrence of surface roughness is inhibited even when molding that results in at least a part of a metal sheet with a thickness decrease of from 10% to 30%.

From the above findings, the metal sheet according to the first embodiment is found to be a metal sheet by which a molded product in which surface roughness is inhibited can be obtained even by molding the metal sheet to cause plane strain tensile deformation and biaxial tensile deformation and causing at least a part of the metal sheet to have a sheet thickness decrease rate of from 10% to 30%.

Hereinafter, details of the metal plate according to the first embodiment will be described.

The condition (a1) will be described.

In the condition (a1), the area fraction of crystal grains A having a crystal orientation divergent by 20° or more from the (111) plane parallel to the surface of a metal sheet and by 20° or more from the (001) plane is from 0.25 to 0.35. However, from the viewpoint of inhibiting surface roughness, the area fraction is preferably from 0.25 to 0.30.

In the condition (a1), the average crystal grain size of crystal grains A is less than 16 μm. However, from the viewpoint of increasing manufacturing cost, for example, the size is 6 μm or more.

The condition (b1) will be described.

In the condition (b1), the area fraction of crystal grains A having a crystal orientation divergent by 20° or more from the (111) plane parallel to the surface of a metal sheet and by 20° or more from the (001) plane is from 0.15 to 0.30. However, from the viewpoint of inhibiting surface roughness, the area fraction is preferably from 0.15 to 0.25.

In the condition (b1), the average crystal grain size of crystal grains A is 16 μm or more. However, from the viewpoint of inhibiting surface roughness, the lower limit of the average crystal grain size of crystal grain A is, for example, 25 μm or less.

As shown in FIG. 1, a grain having a crystal orientation of X° or more away from a (klm) plane means a grain having a crystal orientation in the range of an angle θ formed by two crystal orientations Y1 and Y2 inclined at an acute angle of X° to the (klm) plane on both sides of the (klm) plane.

The average crystal grain size of crystal grain A is measured by the following method.

As shown in FIG. 2, three measurement regions Er of 1 mm square are arbitrarily selected at a center portion (50% of the center of the width) from ¼ of the total width from an edge in the width direction (a direction perpendicular to a rolling direction) of a steel sheet. A sample containing this measurement region Er is collected from the metal sheet. An observation surface (surface including measurement region Er) of the sample is polished by 0.1 mm. The observation surface of the sample is observed with SEM, and crystal grains A are selected using the EBSD method. Two test lines are drawn on each selected crystal grain A. The arithmetic average of the two test lines is calculated to obtain the average crystal grain size of crystal grains A.

Specifically, the method is as follows. As shown in FIG. 3, a first test line that passes the center of gravity of each crystal grain A is drawn such that the first test lines are aligned in the same direction for all crystal grains A. Further, a second test line that passes the center of gravity of each crystal grain A is drawn such that each second test line is orthogonal to the corresponding first test line. The arithmetic average of lengths of the two test lines, the first test line and the second test line, is determined to be the crystal grain size of the corresponding crystal grain A. The arithmetic average of crystal grain sizes of all crystal grains A in three samples is determined to be the average crystal grain size.

In FIG. 3, Cry indicates grain A, L1 indicates the first test line, and L2 indicates the second test line.

The area fraction of crystal grain A is measured by the following method.

In the same manner as in the measurement of the average crystal grain size of grain A, an observation surface of a sample of a metal sheet is observed, and a crystal grain A is selected using the EBSD method. The area fraction of the selected crystal grain A for an observation field of view is calculated. The average of the area fractions of grains A in the three samples is determined to be the area fraction of grain A.

Specifically, the area fraction of crystal grain A is measured as follows.

Using OIM Analysis (manufactured by TSL Corporation), the area of crystal grain A of interest is extracted (tolerance is set at 20°) from the field of view of a scanning electron microscope observed under the following measurement conditions. The extracted area is divided by the area of the observation field of view to obtain the percentage. This value is determined to be the area fraction of grain A.

Details of measurement conditions for determining the area fraction of crystal grain A are as follows.

Measurement device: Scanning Electron Microscope with Electron Backscatter Diffractometer (SEM-EBSD) "SEM: model number JSM-6400 (manufactured by JEOL) and EBSD detector: model number "HIKARI" (manufactured by TSL Corporation) are used"

Step interval: 2 μm

Measurement region: a region of 8000 μm×2400 μm

Grain boundary: Angular difference in crystal orientation of 15° or more (a continuous region with an angular difference of less than 15° is defined as a single crystal grain)

The condition (C1) will be described.

In condition (c1), the area fraction of crystal grains C with a Taylor Factor value (TF value) from 3.0 to 3.4, when assuming plane strain tensile deformation in the transverse direction of a metal sheet in a plane of the metal sheet, is from 0.18 to 0.40. Note that the area fraction is preferably from 0.18 to 0.35 from the viewpoint of inhibiting surface roughness.

The TF value (TF value assuming plane strain tensile deformation of a metal sheet in the transverse direction) of the crystal grain C is calculated by analysis as follows.

An observation surface (surface including measurement region Er) of the sample is polished by 0.1 mm. The observation surface of the sample is observed with SEM, and the crystal orientation distribution data of the observation surface is acquired using the EBSD method. For the crystal orientation distribution data acquired using OIM Analysis v7.2.1 software created by TSL Solutions, Inc., strain tensor representing plane strain tensile deformation is set, Taylor Factor Map is created, and Taylor Factor Distribution is visualized by calculating the TF value for each measurement point.

The area fraction of crystal grain C is measured as follows.

In the same manner as the measurement of the TF value of grain C, for a sample of a metal plate, an observation surface (surface including measurement region Er) of the sample is polished by 0.1 mm. The observation surface of the sample is observed with SEM, and the crystal orientation distribution data of the observation surface is acquired using the EBSD method. For the crystal orientation distribution data acquired using OIM Analysis v7.2.1 software created by TSL Solutions, Inc., strain tensor representing plane strain tensile deformation is set, the existence ratio histogram of TF values is created. From the histogram created, the percentage of measurement points with a Taylor Factor value (TF value) from 3.0 to 3.4 in the total measurement points is calculated as the area fraction of grain C. The average of the area fractions of grain C in three samples is then determined to be the area fraction of grain C.

When the surface of a molded product of a metal sheet to be measured has a plating layer or the like formed thereon, after removing the plating layer or the like, the surface is polished, and the average crystal grain size of crystal grain A and the area fractions of crystal grain A and crystal grain C are measured.

The types of metal sheets will be described.

A metal sheet used herein is a metal sheet having a bcc structure (body-centered cubic lattice structure). A metal sheet having a bcc structure is preferably a metal sheet of α-Fe, Li, Na, K, β-Ti, V, Cr, Ta, W, or the like. Of these, in view of the easiest procurement for producing a molded product, steel sheets (e.g., ferrite-based steel sheets, bainite steel sheet s of bainite single phase texture, and martensite steel sheets of martensite single phase texture) are preferable, and ferrite-based steel sheets are more preferable from the viewpoint of ease of processing. Ferrite-based steel sheets also include steel sheets containing martensite and bainite (DP steel sheets) as well as steel sheets having a metallic structure ferrite fraction of 100%.

The metallic structure ferrite fraction of a ferrite-based steel sheet is preferably 50% or more and more preferably 80% or more. In a case in which the metallic structure ferrite fraction is less than 80%, the influence of hard phase increases. Further, in a case in which it is less than 50%, the hard phase becomes dominant, the influence of an effect of the crystal orientation of ferrite (crystal grains (especially crystal grains having a crystal orientation within 15° from (001) plane parallel to the surface of the metal sheet) other than crystal grains having a crystal orientation within 15° from (111) plane parallel to the surface of a metal sheet), which is vulnerable to stresses of plane strain tensile and biaxial tensile deformations, decreases. Therefore, formation of protrusions and recesses due to deformation of crystal grains tends not to occur upon molding, which makes it difficult to cause surface roughness itself of a molded product to occur. Accordingly, significant effects of inhibiting surface roughness can be obtained with the use of a ferrite-based steel sheet having a ferrite fraction within the above range.

The ferrite fraction can be determined by the method described below. A surface (surface including measurement region Er) of a steel sheet is polished and then immersed in a nital solution, thereby allowing ferrite structure to be exposed. The structure is photographed using an optical microscope. Then, the ferrite structure area with respect to the entire area of the photo of the structure is calculated.

The metal sheet may be a metal sheet (plated steel sheet or the like) having a plating layer on the surface. However, when the metal sheet is a plated metal sheet, the "surface of a metal sheet" on which the average crystal grain size of crystal grain A and the area fractions of crystal grain A and crystal grain C are measured is the surface of the metal sheet excluding the above-described plating layer. The thickness of the plating layer is smaller than the thickness of the metal sheet. Accordingly, the surface properties of a plated metal sheet during and after processing are influenced by the crystal grain size and crystal orientation of the surface of the metal sheet excluding the above-described plating layer.

The thickness of a metal sheet is not particularly limited. However, the thickness is preferably 3 mm or less in view of moldability.

(Chemical Composition of Metal Sheet)

A suitable steel sheet as a metal sheet is preferably a ferrite-based steel sheet having a chemical composition of:

C: from 0.0040% by mass to 0.0100% by mass;

Si: from 0% by mass to 1.0% by mass;

Mn: from 0.90% by mass to 2.00% by mass;

P: from 0.050% by mass to 0.200% by mass;

S: from 0% by mass to 0.010% by mass;

Al: from 0.00050% to 0.10% by mass;

N: from 0% by mass to 0.0040% by mass;

Ti: from 0.0010% by mass to 0.10% by mass;

Nb: from 0.0010% by mass to 0.10% by mass;

B: from 0% by mass to 0.003% by mass;

a total of one or more of Cu or Sn: from 0% by mass to 0.10% by mass; a total of one or more of Ni, Ca, Mg, Y, As, Sb, Pb, or REM: from 0% by mass to 0.10% by mass; and a balance: Fe and impurities, in which the value of F1 as defined in the following Formula (1) is from 0.5 to 1.0.

$$F1=(C/12+N/14+S/32)/(Ti/48+Nb/93). \quad \text{Formula (1)}$$

In Formula (1), the elemental symbols indicate the content of each element in the steel (% by mass).

The chemical composition of a ferrite-based steel sheet that is appropriate as a metal sheet is described below. The symbol "%" means a percent by mass in the chemical composition.

C: from 0.0040% to 0.0100%

It is known that carbon (C) causes reduction of ductibility and deep drawing moldability of a steel sheet in usual types of IF steel. In view of this, a smaller C content is more preferable. C contributes to development of crystal grain A and crystal grain C. Therefore, the content of C is preferably from 0.0040% to 0.0100% to achieve both of them.

Si: from 0 to 1.0%

Silicon (Si) is an optional element. However, Si increases strength of a steel sheet through solid solution strengthening while inhibiting reduction of ductibility of a steel sheet. For such reason, Si may be contained, if necessary. The lower limit of Si content is, for example, 0.005% or more. In a case in which it is intended to strengthen hardness of a steel sheet, the lower limit of Si content is, for example, 0.10% or more. Meanwhile, in a case in which the Si content is excessively high, surface properties of a steel sheet deteriorate. Therefore, the Si content is desirably 1.0% or less. The upper limit of Si content is preferably 0.5% or less. In a case in which strength of a steel sheet is not required, the upper limit of Si content is more preferably 0.05% or less.

Mn: from 0.90% to 2.00%

Manganese (Mn) increases strength of a steel sheet through solid solution strengthening. Further, Mn immobilizes sulfur (S) in the form of MnS. Therefore, hot shortness of steel is inhibited as a result of FeS generation. Further, Mn causes reduction of the temperature of transformation from austenite to ferrite. Accordingly, formation of fine crystal grains of a hot-rolled steel sheet is promoted. In addition, the area fractions of crystal grain A and crystal grain C increase as the content of Mn is increased. On the other hand, from the viewpoint of alloy cost reduction, the upper limit of the content of Mn is, for example, 2.0%. Therefore, the content of Mn is preferably from 0.90% to 2.00%. The content of Mn is preferably from 1.2% to 2.0%, and more preferably from 1.5% to 2.00%.

P: from 0.050% to 0.200%

Phosphorus (P) increases strength of a steel sheet through solid solution strengthening while inhibiting reduction of r value. On the other hand, P, together with Mn, contributes to development of crystal grain A and crystal grain C. On the other hand, when the amount of P is too much, segregation tends to occur and the surface quality after press molding deteriorates. The upper limit of the content of P is, for example, 0.20% from the viewpoint of securing surface properties. Therefore, the content of P is preferably from 0.050% to 0.200%. The content of P is preferably more than 0.100% to 0.200%.

S: from 0% to 0.010%

Sulfur (S) is an optional element. S decreases moldability and ductility of a steel sheet. Therefore, the lower the content of S, the better. Therefore, the content of S is preferably from 0% to 0.010%. From the viewpoint of reducing refining cost, the lower limit of the content of S is, for example, 0.00030%. A preferred upper limit of the content of S is 0.006% or less, and more preferably 0.005% or less.

Al: from 0.00050% to 0.10%

Aluminum (Al) deacidifies liquid steel. On the other hand, when the Al content is excessively large, ductibility of a steel sheet declines. Therefore, the Al content is preferably from 0.00050% to 0.10%. The upper limit of Al content is preferably 0.080% or less, and more preferably 0.060% or less. The lower limit of Al content is preferably 0.00500% or more. The term "Al content" used herein refers to the content of so-called acid-soluble Al (sol. Al).

N: from 0% to 0.0040%

Nitrogen (N) is an optional element. N causes reduction of moldability and ductibility of a steel sheet. For this reason, the lower the N content, the better. Therefore, the content of N is preferably from 0% to 0.0040%. From the viewpoint of reducing refining cost, the lower limit of the content of N is, for example, 0.00030% or more.

Ti: from 0.0010% to 0.10%

Titanium (Ti) binds to C, N, and S, thereby forming carbide, nitride, and sulfide. In a case in which the Ti content is excess with respect to the C content, N content, and S content, a solid solution of C and a solid solution of N decline. Excess Ti, which does not bind to C, N, and S, remains in the form of solid solution in steel. An excessive increase of a solid solution of Ti causes an increase in the recrystallization temperature of steel, which makes it necessary to increase the annealing temperature. Further, when a solid solution of Ti excessively increases, a steel material becomes hardened, which causes deterioration of workability. Accordingly, moldability of a steel sheet declines. Therefore, in order to decrease the recrystallization temperature of steel, the upper limit of Ti content is desirably 0.10% or less. The upper limit of Ti content is preferably 0.08% or less, and more preferably 0.06% or less.

Meanwhile, as stated above, Ti forms a carbonitride, thereby improving moldability and ductibility. In order to obtain this effect, the upper limit of Ti content is desirably 0.0010% or more. The lower limit of Ti content is preferably 0.005% or more, and more preferably 0.01% or more.

Nb: from 0.0010% to 0.10%

Niobium (Nb) binds to C, N, and S, thereby forming carbide, nitride, and sulfide, as with Ti. In a case in which the Nb content is excess with respect to the C content, N content, and S content, a solid solution of C and a solid solution of N decline. Excess Nb, which does not bind to C, N, and S, remains in the form of solid solution in steel. In a case in which a solid solution of Nb excessively increase, it is necessary to increase the annealing temperature. Therefore, in order to decrease the recrystallization temperature of steel, the upper limit of Nb content is desirably 0.10% or less. The upper limit of Nb content is preferably 0.050% or less, and more preferably 0.030% or less.

Meanwhile, as stated above, Nb forms a carbonitride, thereby improving moldability and ductibility. Further, Nb inhibits recrystallization of austenite, thereby causing formation of fine crystal grains of a hot-rolled sheet. In order to obtain this effect, the lower limit of Nb content is desirably 0.0010% or more. The lower limit of Nb content is preferably 0.0012% or more, and more preferably 0.0014% or more.

B: from 0 to 0.0030%

Boron (B) is an optional element. Usually, a steel sheet of ultralow carbon, in which a solid solution of N and a solid solution of C has been reduced, has a low grain boundary strength. Therefore, in a case in which molding that causes plane strain deformation and biaxial tensile deformation, such as deep drawing molding or overhang molding, is conducted, protrusions and recesses are formed, which tends to cause the occurrence of surface roughness of a molded product. B increases grain boundary strength, thereby improving resistance to surface roughness. Therefore, B may be contained, if necessary. Meanwhile, when the B content exceeds 0.0030%, the r value (Lankford value) decreases. Therefore, the upper limit of B content is preferably 0.0030% or less, and more preferably 0.0010% or less in a case in which B is contained.

In order to obtain an effect of increasing grain boundary strength with certainty, it is preferable to set the B content to 0.0003% or more.

Total of one or more of Cu or Sn: from 0% to 0.10%

Cu and Sn are optional elements. In general, when one or more of the elements Cu or Sn are contained, press molding tends to produce significant surface roughness. This is partly because of influence of Cu and Sn on the crystal texture of a steel sheet. However, even when Cu or Sn are contained, surface roughness can be inhibited by developing crystal grain A and crystal grain C.

Note that the total amount of one or more of Cu or Sn is preferably 0.10% or less. On the other hand, Cu and Sn are elements that are difficult to be separated when scrap and the like are used as raw materials. Therefore, from the viewpoint of reducing refining cost, the total amount of one or more of Cu or Sn is preferably from 0.002% to 0.10%.

Total of one or more of Ni, Ca, Mg, As, Sb, Pb, or REM: from 0% to 0.10%

Ni, Ca, Mg, As, Sb, Pb, and REM are optional elements. In general, when one or more of Ni, Ca, Mg, As, Sb, Pb, and REM are contained, press molding tends to produce significant surface roughness. This is partly because of an influence of Ni, Ca, Mg, As, Sb, Pb, and REM on the crystal structure of a steel sheet.

Even when Ni, Ca, Mg, As, Sb, Pb, or REM are contained, surface roughness can be inhibited by developing crystal grain A and crystal grain C.

However, the total amount of one or more of Ni, Ca, Mg, As, Sb, Pb, or REM is 0.10% or less. On the other hand, Ni, Ca, Mg, As, Sb, Pb, and REM are difficult elements to be separated when scrap and the like are used as raw materials. Therefore, from the viewpoint of reducing refining cost, the total amount of one or more of Ni, Ca, Mg, As, Sb, Pb, or REM is preferably from 0.005% to 0.10%.

The term "REM" is a generic term for 17 elements, including Sc, Y, and lanthanides, and the content of REM refers to the total content of one or two or more of the elements in the REM. REM is generally contained in misch metal. Therefore, for example, REM may be contained in the form of a mish metal such that the content of REM is in the above range.

Balance

The balance consists of Fe and impurities. An impurity described herein means a substance that is accidentally mixed in from an ore or scrap as a starting material or in a production environment, etc. upon industrial production of a steel material, which is acceptable unless it disadvantageously affects a steel sheet.

Formula (1) will be described.

F1 defined in Formula (1) is from 0.5 to 1.0.

F1 is a parameter formula indicating a relationship between C, N, and S which cause deterioration of moldability and Ti and Nb. A lower value of F1 means excessive Ti and Nb contents. In this case, as Ti and Nb tend to form carbonitride with C and N, a solid solution of C and a solid solution of N can be reduced. Accordingly, moldability is improved. Note that an excessively low value of F1, which is specifically F1 of 0.5 or less, means significantly excessive Ti and Nb contents. In this case, a solid solution of Ti and a solid solution of Nb increase. In a case in which a solid solution of Ti and a solid solution of Nb increase, the recrystallization temperature of steel increases. Therefore, it is necessary to increase the annealing temperature. In a case in which the annealing temperature is high, the crystal orientation of ferrite (crystal grains (especially crystal grains having a crystal orientation within 15° from (001) plane parallel to the surface of the metal sheet) other than crystal grains having a crystal orientation within 15° from (111) plane parallel to the surface of a metal sheet), which is vulnerable to stresses of plane strain tensile and biaxial tensile deformations tends to grow. In this case, protrusions and recesses due to deformation of crystal grain are formed upon molding, which facilitates the occurrence of surface roughness in a molded product. Therefore, the lower limit of F1 is 0.5 or more.

Meanwhile, an excessively high F1 value causes a solid solution of C and a solid solution of N to increase. In this case, moldability of a steel sheet declines due to age hardening. Further, the recrystallization temperature of steel increases. Therefore, it is necessary to increase the annealing temperature. In a case in which the annealing temperature is high, the crystal orientation of ferrite (crystal grains (especially crystal grains having a crystal orientation within 15° from (001) plane parallel to the surface of the metal sheet) other than crystal grains having a crystal orientation within 15° from (111) plane parallel to the surface of a metal sheet), which is vulnerable to stresses of plane strain tensile and biaxial tensile deformations tends to grow. In this case, protrusions and recesses due to deformation of crystal grain are formed upon molding, which facilitates the occurrence of surface roughness in a molded product. Therefore, the F1 value is preferably 1.0 or less.

The lower limit of the F1 value is preferably 0.6 or more. The upper limit of the F1 value is preferably 0.9 or less.

(Method of Producing Metal Sheet Having bcc Structure)

One example of a method of producing a ferrite-based steel sheet that is preferable as a metal sheet is described below.

In a suitable method of producing a ferrite-based steel sheet, in order to obtain the above-described structure of the ferrite-based steel sheet, cold rolling and annealing conditions are preferably controlled in addition to the above-described chemical composition.

Specifically, a suitable method of producing a ferrite-based steel sheet includes: a step of subjecting a hot-rolled sheet to cold rolling with a draft of 70% or more to obtain a cold-rolled sheet; and a step of annealing the cold-rolled sheet under conditions under which the annealing temperature is the recrystallization temperature +25° C. or less, the temperature irregularity at the surface of the sheet is within ±10° C., and the annealing time is within 100 seconds.

Details of a suitable method of producing a ferrite-based steel sheet are described below.

—Heating Step—

The above-described slab is heated in the heating step. For heating, it is preferable to set the finishing temperature for finishing rolling in the hot rolling step (surface temperature of a hot-rolled steel sheet after the last stand) within a range of Ar3+30° C. to 50° C., if appropriate. In a case in which the heating temperature is 1000° C. or more, the finishing temperature tends to be Ar3+30° C. to 50° C. It is therefore preferable that the lower limit of heating temperature is 1000° C. In a case in which the heating temperature exceeds 1280° C., it results in scale formation in a large amount, which causes the yield to decrease. It is therefore preferable that the upper limit of heating temperature is 1280° C. In a case in which the heating temperature is within the above-described, ductibility and moldability of a steel sheet are improved at a lower heating temperature. It is therefore more preferable that the upper limit of heating temperature is 1200° C.

—Hot Rolling Step—

The hot rolling step involves rough rolling and finishing rolling. Rough rolling is to roll a slab to result in a certain thickness, thereby producing a hot-rolled steel sheet. Scale formed on the surface may be removed during rough rolling.

The temperature during hot rolling is maintained such that steel is within the austenite range. Distortion is accumulated in austenite crystal grains by hot rolling. The steel structure is transformed from austenite to ferrite by cooling after hot rolling. The release of distortion accumulated in austenite crystal grains is inhibited during hot rolling because the temperature is within the austenite range. Cooling after hot rolling causes austenite crystal grains in which distortion has been accumulated to be transformed to ferrite at once, which is driven by accumulated distortion, when the temperature reaches a given temperature range. This allows formation of fine crystal grains in an efficient way. In a case in which the finishing temperature after hot rolling is Ar3+30° C. or more, transformation from austenite to ferrite can be inhibited during rolling. Therefore, the lower limit of finishing temperature is Ar3+30° C.

Meanwhile, in a case in which the finishing temperature is Ar3+100° C. or more, distortion accumulated in austenite crystal grains is readily released by hot rolling. This makes it difficult to form fine crystal grains in an efficient way. It is therefore preferable that the upper limit of finishing temperature is Ar3+100° C. In a case in which the finishing temperature is Ar3+50° C. or less, strain can be stably accumulated in austenite crystal grains, and, fine crystal grains can be formed. Therefore, the upper limit of finishing temperature is preferably Ar3+50° C.

Finishing rolling is to further roll a hot-rolled steel sheet that has a certain thickness as a result of rough rolling. Upon finishing rolling, continuous rolling is conducted by a plurality of paths using a plurality of stands aligned in series. A greater draft per path means a larger amount of strain accumulated in austenite crystal grains. In particular, the draft for the last two paths (i.e., the draft for the last stand and the stand second to the last) is set to 50% or more by adding up sheet thickness decrease rates. In this case, fine crystal grains of a hot-rolled steel sheet can be formed.

—Cooling Step—

After hot rolling, a hot-rolled steel sheet is cooled. Cooling conditions can be set, if appropriate. The maximum rate of cooling until termination of cooling is preferably 100° C./s or more. In this case, strain accumulated in austenite crystal grains as a result of hot rolling is released, which facilitates formation of fine crystal grains. A more rapid cooling rate is more preferable. The time period from the completion of rolling to cooling to 680° C. is preferably from 0.2 to 6.0 seconds. In a case in which the time period from the completion of rolling to cooling to 680° C. is 6.0 seconds or less, fine crystal grains can be easily formed after hot rolling. In a case in which the time period from the completion of rolling to cooling to 680° C. is 2.0 seconds or less, further fine crystal grains can be easily formed after hot rolling.

—Winding Step—

It is preferable to conduct the winding step at from 400° C. to 690° C. In a case in which the winding temperature is 400° C. or more, it is possible to prevent a solid solution of C or a solid solution of N from remaining due to insufficient carbonitride precipitation. In this case, moldability of a cold-rolled steel sheet is improved. In a case in which the winding temperature is 690° C. or less, it is possible to inhibit formation of coarse crystal grains during slow cooling after winding. In this case, moldability of a cold-rolled steel sheet is improved.

[Cold Rolling Step]

After the winding step, a hot-rolled steel sheet is treated by cold rolling, thereby producing a cold-rolled steel sheet. A greater draft in the cold rolling step is preferable. By increasing the draft, the r value of the material, which has a strong correlation with the drawing moldability, can be easily increased in an annealing step. Therefore, the draft of cold-rolling is preferably 70% or more. Due to the rolling facility, the practical upper limit of the draft of a steel sheet after annealing in the cold rolling step is 95%.

—Annealing Step—

The annealing step is conducted for a cold-rolled steel sheet after the cold rolling step. The annealing method may involve either continuous annealing or box annealing.

Annealing is preferably carried out under conditions under which the annealing temperature is the recrystallization temperature +25° C. or less, the temperature irregularity at the surface of the sheet is within ±10° C., and the annealing time is within 100 seconds. Annealing under these conditions facilitates development of crystal grain A and crystal grain C.

The recrystallization temperature is calculated as follows. After holding the material at a temperature from 600° C. to 900° C. for 60 seconds, a sample with a cross-section (L cross-section) parallel to the rolling direction is obtained by cutting. Next, the cut surface of the sample is polished and nital-corroded, and the material structure in the cross-section is observed. By analyzing whether or not an elongated rolled structure remains, the lowest temperature at which no rolled structure remains is determined to be the recrystallization temperature.

Unevenness of temperature in the surface of a sheet is measured as follows. A thermocouple is attached to a material at three points, the center and both ends thereof in the rolling width direction, and the temperature is held at from 600° C. to 900° C. for 60 seconds, and then the temperature is measured. The average temperature of the three points is calculated, and differences from the highest and lowest temperatures are measured as unevenness of temperature.

The annealing time indicates time from reaching a target annealing temperature to cooling down.

The annealing temperature distribution of a ferrite-based steel sheet is preferably more uniform than an annealing temperature distribution of a conventional technique. The annealing temperature needs to be lowered in order to inhibit coarsening of crystal grains and to obtain a crystal structure suitable for inhibiting surface roughness after press molding. However, the lowest temperature in an object to be heated needs to be set to a temperature equal to or higher than the recrystallization temperature. In other words, in order to set the annealing temperature lower, unevenness of temperature on the surface of a sheet needs to be reduced. For this purpose, from the viewpoint of the responsiveness of a feedback control according to the temperature of a steel sheet, a heating device using near-infrared rays as a heat source is desirable, and one which can control the output of the heat source in the width direction of the material at each position is more desirable. As described above, in order to increase the area fraction of crystal grain A and crystal grain C, it is preferable to increase the content of C, the content of P, and the content of Mn compared to a conventional technique.

A ferrite-based steel sheet, which is a preferable metal sheet, can be produced by the above steps.

(Method of Producing Molded Product of bcc Structure Having Metal Sheet)

The method of producing a molded product of a metal sheet according to the first embodiment is a method of producing a molded product of a metal sheet, the method including treating the metal sheet according to the first embodiment, molding the metal sheet to cause plane strain tensile deformation and biaxial tensile deformation, and causing at least a part of the metal sheet to have a sheet thickness decrease rate of from 10% to 30%.

Examples of molding include deep drawing molding, overhang molding, drawing overhang molding, and bending molding. Specifically, molding is, for example, a method of treating a metal sheet 10 by overhang molding as illustrated in FIG. 4A. Upon such molding, an edge portion of a metal sheet 10 is sandwiched between a die 11 and a holder 12 provided with a drawbead 12A. Thus, the drawbead 12A is engaged with the surface of the edge portion of the metal sheet 10 such that the metal sheet 10 is in a state of being fixed. The metal sheet 10 in such state is pressed by a punch 13 having a flat top face, thereby treating the metal sheet 10 by overhang molding. FIG. 4B illustrates one example of a molded product obtained by overhang molding illustrated in FIG. 4A.

In the case of overhang molding illustrated in FIG. 4A, plane strain deformation occurs on, for example, a metal sheet 10 positioned on the lateral side of a punch 13 (corresponding to a portion on the lateral wall of a molded product). Meanwhile, equi-biaxial deformation or non-equi-biaxial tensile deformation relatively close to equi-biaxial deformation occurs on the metal sheet 10 positioned on the top face of the punch 13 (corresponding to the top face of a molded product).

In addition, one example method of molding is a method of treating a metal sheet 10 by overhang molding as illustrated in FIG. 5A. Upon such molding, an edge portion of a metal sheet 10 is sandwiched between a die 11 and a holder 12 provided with a drawbead 12A. Thus, the drawbead 12A is engaged with the surface of the edge portion of the metal sheet 10 such that the metal sheet 10 is in a state of being fixed. Then, the metal sheet 10 in such state is pressed by a punch 13 having a top face that protrudes in an approximate V shape, thereby treating the metal sheet 10 by drawing overhang molding. FIG. 5B illustrates one example of a molded product obtained by drawing overhang molding illustrated in FIG. 5A.

In the case of drawing overhang molding illustrated in FIG. 5A, plane strain deformation occurs on, for example, a metal sheet 10 positioned on the lateral side of a punch 13 (corresponding to a portion on the lateral side of a molded product). Meanwhile, non-equi-biaxial tensile deformation relatively similar to equi-biaxial deformation occurs on the metal sheet 10 positioned on the top face of the punch 13 (corresponding to the top face of a molded product). Plane strain tensile deformation occurs on the metal sheet 10 (corresponding to the ridge line of a molded product) positioned on the top of the punch 13.

As illustrated in FIG. 6, plane strain tensile deformation is a mode of deformation that causes extension in the $\varepsilon 1$ direction but not in the $\varepsilon 2$ direction. In addition, biaxial tensile deformation is a mode of deformation that causes extension in both the $\varepsilon 1$ direction and the $\varepsilon 2$ direction. Specifically, plane strain tensile deformation is a mode of deformation on the condition that given that strains in the biaxial directions are designated as the maximum main strain $\varepsilon 1$ and the minimum main strain $\varepsilon 2$, the strain ratio $\beta$ ($=\varepsilon 2/\varepsilon 1$) is $\beta=0$. Biaxial tensile deformation is a mode of deformation on the condition that the strain ratio $\beta$ ($=\varepsilon 2/\varepsilon 1$) is $0<\beta\leq 1$. In addition, non-equi-biaxial deformation is a mode of deformation on the condition that the strain ratio $\beta$ ($=\varepsilon 2/\varepsilon 1$) is $0<\beta<1$, and equi-biaxial deformation is a mode of deformation on the condition that the strain ratio $\beta$ ($=\varepsilon 2/\varepsilon 1$) is $\beta=1$. Note that uniaxial tensile deformation is a mode of deformation that causes extension in the $\varepsilon 1$ direction while causing shrinkage in the $\varepsilon 2$ direction on the condition that the strain ratio $\beta$ ($=\varepsilon 2/\varepsilon 1$) is $-0.5\leq\beta<0$.

Note that the above-described strain ratio $\beta$ is within a range of theoretical values. For example, the range of strain ratio $\beta$ for each mode of deformation, which is calculated based on the maximum main strain and the minimum main strain determined from changes in the shapes of scribed circles transferred to a surface of a steel sheet before and after steel sheet molding (before and after steel sheet deformation), is described below. The range of strain ratios $\beta$ for each deformation is as follows.

Uniaxial tensile deformation: $-0.5<\beta\leq -0.1$

Plane strain tensile deformation: $-0.1<\beta\leq 0.1$

Non-equi-biaxial deformation: $0.1<\beta\leq 0.8$

Equi-biaxial deformation: $0.8<\beta\leq 1.0$

Meanwhile, molding is conducted at a machining amount that causes at least a portion of a metal sheet to have a sheet thickness decrease rate of from 10% to 30%. At a machining amount that results in a sheet thickness decrease rate of less than 10%, there is a tendency that formation of protrusions and recesses are difficult to develop upon molding. Therefore, even when a metal sheet does not satisfy the conditions (a1), (b1), or (c1) described above, surface roughness of a molded product itself is unlikely to occur. Meanwhile, when the sheet thickness decrease rate exceeds 30%, there is an increased tendency that molding causes fracture of a metal sheet (molded product). Therefore, the machining amount of molding is set to fall within the above-described range.

Molding is conducted at a machining amount that causes at least a portion of a metal sheet to have a sheet thickness decrease rate of from 10% to 30%. However, molding may be conducted at a machining amount that causes the entire metal sheet excluding an edge portion (a portion sandwiched between a die and a holder) to have a sheet thickness decrease rate of from 10% to 30%. It is particularly preferable to conduct molding at a machining amount that causes a portion of a metal sheet which is positioned on the top face of a punch (a portion of a metal sheet to be treated by biaxial tensile deformation) to have a sheet thickness decrease rate of from 10% to 30%, although it depends on the shape of a molded product obtained by molding. A portion of a metal sheet which is positioned on the top face of a punch is likely to be seen in a case in which a molded product is used as an exterior member. For such reason, when this portion of a metal sheet is treated by molding at a large machining amount corresponding to a sheet thickness decrease rate of from 10% to 30%, significant effects of inhibiting surface roughness can be obtained by inhibiting formation of protrusions and recesses.

Given that the sheet thickness of a metal sheet before molding is represented by Ti and sheet thickness of a metal sheet after molding (molded product) is represented by Ta, the sheet thickness decrease rate is expressed by the following formula: sheet thickness decrease rate=(Ti−Ta)/Ti.

(Molded Product of Metal Sheet Having bcc Structure)

The molded product of a metal sheet according to the first embodiment is a molded product of a metal sheet having a bcc structure and including a ridge line, satisfying the following conditions (BD) and (BH), and satisfying the following conditions (a2), (b2), or (c2) at a surface portion with a maximum sheet thickness:

(BD) when the maximum sheet thickness of the molded product is D1 and the minimum sheet thickness of the molded product is D2, $10 \leq (D1-D2)/D1 \times 100 \leq 30$;

(BH) when the maximum Vickers hardness of the molded product is H1, and the minimum Vickers hardness of the molded product is H2, $15 \leq (H1-H2)/H1 \times 100 \leq 40$;

(a2) the area fraction of crystal grains (crystal grain A) having a crystal orientation of 20° or more from a (111) plane parallel to a surface of the metal sheet and 20° or more from a (001) plane is from 0.25 to 0.35, and the average crystal grain size is less than 16 μm;

(b2) the area fraction of crystal grains (crystal grain A) having a crystal orientation of 20° or more from a (111) plane parallel to a surface of the metal sheet and 20° or more from a (001) plane is from 0.15 to 0.30, and the average crystal grain size is 16 μm or more.

(c2) the area fraction of crystal grains (crystal grain C) with a Taylor Factor value from 3.0 to 3.4, when assuming plane strain tensile deformation in a direction orthogonal to an extension direction of the ridge line at a minimum radius of curvature of a concave surface of the ridge line in a cross-section orthogonal to an extension direction of the ridge line, is from 0.18 to 0.35.

—One Example of Molded Product of Metal Sheet According to First Embodiment—

FIG. 7 shows an example of the molded product of a metal sheet according to the first embodiment.

As shown in FIG. 7, a molded product 10 of a metal sheet according to the first embodiment includes, for example, a ridge line 12 at a bulge 13 that is part or all of a design surface 11. Specifically, for example, the molded product 10 of a metal sheet is a molded product of a metal sheet substantially on a hat side including: a top panel 14 including a ridge line 12; a wall 16 adjacent to the perimeter of the top panel 14; and a flange 18 adjacent to the perimeter of the wall 16. In short, the bulge 13 includes the top panel 14 and the wall 16. The flange 18 may be partially or completely removed.

The shape of the molded product 10 of a metal sheet is not limited to the above-described configuration as long as the sheet face includes the ridge line 12, and various shapes (such as a dome shape) can be adopted depending on the purpose.

The ridge line 12 is provided in a straight line shape on the top panel 14 in a plan view of the molded product 10 of a metal sheet. The ridge line 12 is provided in a convexly curved streamline in a side view of the molded product 10 of a metal sheet as viewed from an orthogonal direction of the ridge line 12.

The ridge line 12 is positioned, for example, more than 10 mm away from an edge (e.g., an edge of a flange 18A that is orthogonal to the ridge line 12) of the molded product 10 of a metal sheet. In other words, the ridge line 12 is, for example, provided inwardly from a shoulder 14A (or a wall 16A) along an extension direction of the ridge line 12, which is a boundary between the top panel 14 and the wall 16. The ridge line 12 may extend through a shoulder 14B (or a wall 16B), which intersects an extension direction of the ridge line 12, to a flange 18B at an extension direction of the ridge line 12.

The ridge line 12 is not limited to the above aspect, and may be straight line or streamlined in plan view. In side view, the ridge line 12 may be straight line or streamlined.

—Conditions—

The molded product of a metal sheet according to the first embodiment satisfying the condition (BD) (condition of a formula: $10 \leq (D1-D2)/D1 \times 100 \leq 30$) can be regarded that the molded product has been formed by a molding that allows at least a part of a metal sheet to have a sheet thickness decrease rate of from 10% to 30%.

In other words, the maximum sheet thickness D1 of a molded product can be regarded as the sheet thickness of a metal sheet before molding, and the minimum sheet thickness D2 of a molded product can be regarded as the sheet thickness of a portion of a metal sheet (molded product) having the largest sheet thickness decrease rate after molding.

Meanwhile, also in a case in which the condition (BH) (condition of a formula: $15 \leq (H1-H2)/H1 \times 100 \leq 40$) is satisfied, it can be regarded that a molded product has been formed by molding that allows at least a part of a metal sheet to have a sheet thickness decrease rate of from 10% to 30%. This is based on the fact that as the machining amount (sheet thickness decrease rate: thickness reduction) upon molding increases, the degree of work hardening (i.e., work hardness: Vickers hardness) increases.

In other words, a portion of a molded product having the maximum Vickers hardness H1 can be regarded as the Vickers hardness of a portion of a metal sheet (molded product) having the largest sheet thickness decrease rate after molding, and the minimum Vickers hardness H2 of a molded product can be regarded as the hardness of a metal sheet before molding.

Here, Vickers hardness is measured by the Vickers hardness (HV) measurement method specified in the Japanese Industrial Standards (JIS) (JIS Z 2244(2009)). Test force=294.2 N (=30 kgf) is adopted as a measurement condition.

Satisfying the condition (a2) indicates that the molded product is a molded product formed by molding the metal sheet according to the first embodiment satisfying the condition (a2).

Satisfying the condition (b2) indicates that the molded product is a molded product formed by molding the metal sheet according to the first embodiment satisfying the condition (b1).

Here, in the conditions (a2) and (b2), the area fraction and average crystal grain size of crystal grain A are measured at a location of the molded product having the maximum sheet thickness D1 or the minimum Vickers hardness H2.

The conditions (a2) and (b2) are the same as the conditions (a1) and (b1) described for the metal sheet according to the first embodiment, except that the area fraction and average crystal grain size of crystal grain A of a molded product are used instead of the metal sheet before molding.

Satisfying the condition (c2) indicates that the molded product is a molded product obtained by molding the metal sheet according to the first embodiment satisfying the condition (c1). The reasons for this are as follows Biaxial tensile or plane strain deformation of a metal sheet leads to development of ND (111) or ND (001) crystal structure. This reduces the area fraction of grain C in a molded product, and thus the upper limit of the desired area fraction of crystal grain C under conditions (c2) and (c1) varies. Therefore, satisfying the condition (c2) indicates that the molded product is a molded product obtained by molding the metal sheet according to the first embodiment satisfying the condition (c1).

ND indicates a normal direction of a rolling surface.

In the condition (c2), the Taylor Factor value is measured in accordance with the measurement method of "Taylor Factor value when assuming plane strain tensile deformation in the transverse direction" in the condition (c1), except that plane strain tensile deformation in a direction orthogonal to an extension direction of a ridge line is assumed.

The minimum radius of curvature of a concave surface of a ridge line in a cross-section orthogonal to an extension direction of the ridge line (see FIG. 8: R1 in the figure indicates the radius of curvature) is measured as follows. First, the three-dimensional shape of the concave surface of the ridge line is measured by a three-dimensional shape measuring instrument. Next, continuous cross-sections in the orthogonal direction of the ridge line are obtained along a direction parallel to the ridge line using computer CAD software (e.g., 3DCAD Solidworks), and a portion having the smallest radius of curvature in the radius of curvature of the concave surface of the ridge line is defined as the minimum radius of curvature.

In the molded product of a metal sheet of the first embodiment, the metal sheet is treated by molding that causes plane strain tensile deformation and biaxial tensile deformation.

Whether a molded product is treated by molding that causes plane strain tensile deformation and biaxial tensile deformation is confirmed in the following manner.

The three-dimensional shape of a molded product is measured, and a shape model separated by finite elements for numerical analysis is prepared based on measurement data. The process of forming a sheet material into a three-dimensional shape is developed by back analysis using a computer. Then, the ratio (β described above) between the maximum main strain and the minimum main strain for each shape model is calculated. Whether a molded product is treated by molding that causes plane strain tensile deformation and biaxial tensile deformation can be confirmed based on the calculation.

For example, a three-dimensional shape of a molded product is measured by a three-dimensional measuring instrument Comet L3D (Tokyo Boeki Techno-System Ltd.) or the like. Mesh shape data of a molded product are obtained based on the obtained measurement data. Next, the obtained mesh shape data are used for developing the mesh shape on a flat sheet based on the original molded product shape by numerical analysis in accordance with the one-step method (using a work hardening calculation tool "HYCRASH (JSOL Corporation)" or the like). A change in the sheet thickness, the residual strain, and other factors are calculated for a molded product based on the shape information of the analysis including the extension and bending status of a molded product. Whether a molded product is treated by molding that causes plane strain tensile deformation and biaxial tensile deformation can also be confirmed based on the above calculation.

As described above, the molded product of a metal sheet according to the first embodiment can be regarded as a molded product obtained by molding the metal sheet according to the first embodiment by the method of producing a molded product of a metal sheet according to the first embodiment by satisfying each of the above-described conditions.

Therefore, the molded product of a metal sheet according to the first embodiment is a molded product of a metal sheet in which occurrence of surface roughness is inhibited, even when the molded product is a molded product of a metal sheet including a bcc structure, provided with a ridge line, and satisfying the condition (BD) and the condition (BH).

(Metal Sheet Having fcc Structure)

The metal sheet according to a second embodiment is a metal sheet having an fcc structure and satisfying the following condition (a1), (b1), or (c1) at a surface thereof:

(a1) the area fraction of crystal grains (crystal grain A) having a crystal orientation of 20° or more from a (111) plane parallel to a surface of the metal sheet and 20° or more from a (001) plane is from 0.25 to 0.35, and the average crystal grain size is less than 16 μm;

(b1) the area fraction of crystal grains (crystal grain A) having a crystal orientation of 20° or more from a (111) plane parallel to a surface of the metal sheet and 20° or more from a (001) plane is from 0.15 to 0.30, and the average crystal grain size is 16 μm or more;

(c1) the area fraction of crystal grains (crystal grain C) with a Taylor Factor value from 3.0 to 3.4, when assuming plane strain tensile deformation in the transverse direction in a plane of the metal sheet, is from 0.18 to 0.40.

With the above-described configuration, the metal sheet according to the second embodiment can provide a molded product in which surface roughness is inhibited even by molding the metal sheet to cause plane strain tensile deformation and biaxial tensile deformation and causing at least a part of the metal sheet to have a sheet thickness decrease rate of from 10% to 30%. The metal sheet according to the second embodiment was discovered by the following findings.

The inventors focused on a slip system (slip plane and slip direction) in the crystal structure of a metal sheet having a bcc structure and a metal sheet having an fcc structure. In other words, the inventors focused on the following. A slip plane of a crystal structure of a metal sheet having a bcc structure is parallel to a slip direction of a crystal structure of a metal sheet having an fcc structure. A slip direction of a crystal structure of a metal sheet having a bcc structure is parallel to a slip plane of a crystal structure of a metal sheet having an fcc structure. The strength distribution of a metal sheet having an fcc structure for each crystal orientation in biaxial tensile deformation is estimated to be similar to that of a metal sheet having a bcc structure. (See Table 1 below).

TABLE 1

| Crystal structure | Slip plane | Slip direction |
|---|---|---|
| bcc structure (body-centered cubic lattice) | {110} | <1$\bar{1}$1> |
| fcc structure (face-centered cubic lattice) | {111} | <1$\bar{1}$0> |

Focusing on the slip system in both crystal structures, the inventors studied the relationship between crystal orientation of crystal grains and surface roughness of a molded product in biaxial deformation fields (equi-biaxial and non-equi-biaxial tensile deformation fields) of a metal sheet having an fcc structure by crystal plasticity finite element analysis (R. Becker, "Effects of strain localization on surface roughening during sheet forming", Acta Mater. Vol. 46. No. 4. pp. 1385-1401, 1998).

Specifically, the slip system of crystal orientation of a cross-section of a metal sheet having a bcc structure was changed to a slip system of a metal sheet having an fcc structure, and the area fraction of crystal grain A on a surface of the metal sheet was changed. An effect of surface roughness of the metal plate due to plastic strain in this case was studied by numerical analysis.

As a result, the inventors obtained the following findings. As in the case of a metal sheet having a bcc structure, in the case of a metal sheet having an fcc structure, increasing the fraction of crystal grains with crystal orientations other than the (001) and (111) planes inhibits increase in surface roughness in plane strain tensile deformation, even when a metal sheet is formed at a large machining amount (machining amount that results in a sheet thickness decrease rate of 10% or more of a metal sheet). As a result, the degree of crystal grain deformation is reduced between isobiaxial and plane strain tensile deformations, and the difference in surface roughness development is reduced.

In other words, as in the case of a metal sheet having a bcc structure, in the case of a metal sheet having an fcc structure, when the condition (a1) or the condition (b1) is satisfied, surface roughness is inhibited even when plane strain tensile deformation and biaxial tensile deformation occur and at least a part of a metal sheet is subjected to molding that results in a thickness decrease rate of from 10% to 30%.

On the other hand, the inventors also conducted the following studies.

First, also in the case of a metal sheet having an fcc structure, the inventors focused on Taylor Factor value (TF value) when assuming plane strain tensile deformation of a metal sheet in the transverse direction.

As a result, the inventors obtained the following findings.

As in the case of a metal sheet having a bcc structure, in the case of a metal sheet having an fcc structure, by controlling the fraction of crystal grain C, the increase in surface roughness in plane strain tensile deformation is inhibited even when a metal sheet is formed at a large machining amount. As a result, the degree of deformation of crystal grains is reduced between isobiaxial and plane strain tensile deformation, and the difference in surface roughness development is reduced.

The reason for the reduction in the difference in surface roughness development even for a metal sheet having an fcc structure is considered to be the same as in the case of a metal sheet having a bcc structure described above.

In other words, also in the case of a metal sheet having an fcc structure, when the condition (c1) is satisfied, plane and biaxial tensile deformations occur, and occurrence of surface roughness is inhibited even when molding that results in at least a part of a metal sheet with a thickness decrease of from 10% to 30%.

From the above findings, the metal sheet according to the second embodiment is found to be a metal sheet by which a molded product in which surface roughness is inhibited can be obtained even by molding the metal sheet to cause plane strain tensile deformation and biaxial tensile deformation and causing at least a part of the metal sheet to have a sheet thickness decrease rate of from 10% to 30%.

Hereinafter, details of the metal plate according to the second embodiment will be described.

In the metal sheet according to the second embodiment, conditions (a1), (b1), and (c1) are the same as conditions (a1), (b1), and (c1) described for the metal sheet according to the first embodiment.

The metal sheet according to the second embodiment includes an fcc structure (face-centered cubic lattice structure). Examples of the metal sheet having an fcc structure include a metal sheet of γ-Fe (austenitic stainless steel), Al, Cu, Au, Pt, or Pb.

Among these, the metal sheet is preferably an austenitic stainless steel sheet or an aluminum alloy sheet.

The thickness of a metal sheet is not particularly limited. However, the thickness is preferably 3 mm or less in view of moldability.

The metal sheet of the second embodiment is the same as the metal sheet of the first embodiment, except that the metal sheet has an fcc structure (face-centered cubic lattice structure).

(Method of Producing Molded Product of fcc Structure Having Metal Sheet)

The method of producing a molded product of a metal sheet according to the second embodiment is a method of producing a molded product of a metal sheet, the method including treating the metal sheet according to the second embodiment, molding the metal sheet to cause plane strain tensile deformation and biaxial tensile deformation and causing at least a part of the metal sheet to have a sheet thickness decrease rate of from 5% to 30%.

The method of producing a molded product of a metal sheet according to the second embodiment is the same as the method of producing a molded product of a metal sheet according to the first embodiment, except that the metal sheet according to the second embodiment is used as the metal sheet. Therefore, overlapping descriptions will be omitted.

Note that, in the method of producing a molded product of a metal sheet according to the second embodiment, the lower limit of the sheet thickness decrease rate is 5% or more. The reason for this is that a metal sheet having an fcc structure differs from a metal sheet having a bcc structure in that surface roughness tends to occur from a thickness decrease rate of 5%. In the method of producing a molded product of a metal sheet according to the second embodiment, a molded product of a metal sheet with controlled surface roughness can be obtained even when the thickness decrease rate is 5%.

(Molded Product of Metal Sheet Having fcc Structure)

The molded product of a metal sheet according to the first embodiment is a molded product of a metal sheet having an fcc structure and including a ridge line, satisfying the following conditions (FD) and (FH), and satisfying the following conditions (a2), (b2), or (c2) at a surface portion with a maximum sheet thickness:

(FD) when the maximum sheet thickness of the molded product is D1 and the minimum sheet thickness of the molded product is D2, $5 \leq (D1-D2)/D1 \times 100 \leq 30$;

(FH) when the maximum Vickers hardness of the molded product is H1, and the minimum Vickers hardness of the molded product is H2, $7 \leq (H1-H2)/H1 \times 100 \leq 40$;

(a2) the area fraction of crystal grains having a crystal orientation divergent by 20° or more from a (111) plane parallel to a surface of the molded product and by 20° or more from a (001) plane is from 0.25 to 0.35, and the average crystal grain size is less than 16 μm; or (b2) the area fraction of crystal grains having a crystal orientation divergent by 20° or more from a (111) plane parallel to a surface of the molded product and by 20° or more from a (001) plane is from 0.15 to 0.30, and the average crystal grain size is 16 μm or more.

(c2) the area fraction of crystal grains with a Taylor Factor value from 3.0 to 3.4, when assuming plane strain tensile deformation in a direction orthogonal to an extension direction of the ridge line at a minimum radius of curvature of a concave surface of the ridge line in a cross-section orthogonal to an extension direction of the ridge line, is from 0.18 to 0.35.

The molded product of a metal sheet according to the second embodiment is the same as the molded product of a metal sheet according to the first embodiment except for having an fcc structure and satisfying the conditions (FD) and (FH). Therefore, overlapping descriptions will be omitted.

Note that the condition (FD) is the same as the condition (BD) except that, in the molded product of a metal sheet according to the second embodiment, the lower limit of $(D1-D2)/D1 \times 100$ is 5 or more. The condition (FH) is the same as the condition (BH) except that the lower limit of $(H1-H2)/H1 \times 100$ is 7 or more. The reason for this is that, unlike a molded product of a metal sheet having a bcc structure, a molded product of a metal sheet having an fcc structure tends to produce surface roughness from $(D1-D2)/D1 \times 100=5$ and from $(H1-H2)/H1 \times 100=7$. The molded product of a metal sheet according to the second embodiment is a molded product of a metal sheet with controlled surface roughness, even when $(D1-D2)/D1 \times 100=5$ and $(H1-H2)/H1 \times 100=7$.

EXAMPLES

Example A (Production of Steel Sheet)

Steel pieces each having either one of the chemical compositions listed in Table 2 were processed under the corresponding conditions listed in from Table 3 to Table 4. Specifically, at first, the steel pieces were treated in a heating step, a hot rolling step, a winding step, a cold rolling step, and an annealing step. An experimental roller was used to carry out a hot rolling step under the conditions shown in Table 3. Next, each hot-rolled steel sheet cooled to the winding temperature was introduced into an electric furnace maintained at a temperature corresponding to the winding temperature. The temperature was maintained for 30 minutes and cooling was conducted under the conditions shown in from Table 3 to Table 4, followed by simulation of a winding step. Further, a cold rolling step was conducted under conditions listed in Table 3. The thus obtained each cold-rolled steel sheet was annealed under conditions listed in from Table 3 to Table 4.

Through the above process, desired steel sheets were obtained. The ferrite fractions of the obtained steel sheets were 100%.

[Forming of Molded Product]

Next, the obtained steel sheet (steel sheet having a bcc structure) was then subjected to a drawing process, and a molded product shown in FIG. 7 was obtained. The dimensions of the molded product were W=400 mm, L=400 mm, H11=95 mm, H12=100 mm, H2=25 mm, and the minimum radius of curvature of a concave surface of a ridge line in a cross-section orthogonal to an extension direction of the ridge line, θ (not illustrated)=1/1600 mm.

The forming process was carried out at a machining amount such that the sheet thickness decrease rate of a steel sheet resulting in an evaluation portion (the minimum radius of curvature of a concave surface of a ridge line in a cross-section orthogonal to an extension direction of the ridge line) of the molded product was the sheet thickness decrease rate listed in Table 5.

In the forming of the above-described molded product, scribed circles were transcribed onto the surface of the steel sheet corresponding to the evaluation portion of the molded product, and the maximum and minimum principal strains were measured by measuring the shape changes of the scribed circles before and after forming (before and after deformation). A deformation ratio β for the evaluation portion of a molded produce was calculated based on the obtained values.

[Evaluation Method]

The following measurement tests and visual evaluations were performed on the obtained steel sheets and molded products. Tables 3 to 5 show the results.

An example of a molding condition in which the sheet thickness decrease rate is less than 10% is an example in which the amount of strain is small and no surface unevenness occurs, and is therefore described as Reference Example.

[Measurement Test of Area Fraction and Average Crystal Grain Size of Crystal Grain]

The area fraction and average crystal grain size of the following grains were measured according to the methods described above.

Crystal grain A (crystal grains having a crystal orientation divergent by 20° or more from a (111) plane parallel to a surface of the metal sheet and 20° or more from a (001) plane)

The area fraction of Crystal grain C1 (crystal grains with a Taylor Factor value from 3.0 to 3.4, when assuming plane strain tensile deformation in the transverse direction in a plane of the metal sheet)

The area fraction of Crystal grain C2 (crystal grains with a Taylor Factor value from 3.0 to 3.4, when assuming plane strain tensile deformation in a direction orthogonal to an extension direction of the ridge line at a minimum radius of curvature of a concave surface of the ridge line in a cross-section orthogonal to an extension direction of the ridge line)

In Tables, each area fraction was expressed in % (i.e., a value multiplied by 100).

[Sheet Thickness Measurement Test]

A sheet thickness measurement test was conducted for each molded product. Specifically, molding simulation of each molded product was conducted using a computer, thereby identifying a portion having the maximum sheet thickness and a portion having the minimum sheet thickness. Subsequently, sheet thickness measurement was conducted for each molded product at a portion having the maximum sheet thickness and a portion having the minimum sheet thickness using a sheet thickness gauge. Thus, the maximum sheet thickness D1 and the minimum sheet thickness D2 were obtained. Note that the maximum sheet thickness of a molded product (the entire molded product) was obtained as the maximum sheet thickness D1, and the minimum sheet thickness of an evaluation portion of a molded product was obtained as the minimum sheet thickness D2.

[Vickers Hardness Measurement Test]

A Vickers hardness measurement test was conducted for each molded product. Specifically, molding simulation of each molded product was conducted using a computer, thereby identifying a portion having the maximum equivalent plastic strain and a portion having the minimum equivalent plastic strain. Subsequently, Vickers hardness measurement was conducted for each molded product at a portion having the maximum sheet thickness and a portion having the minimum sheet thickness in accordance with JIS (JIS Z 2244 (2009)). Thus, the maximum Vickers hardness H1 and the minimum Vickers hardness H2 were obtained. Note that the maximum Vickers hardness of a molded product (the entire molded product) was obtained as the maximum Vickers hardness H1, and the minimum Vickers hardness of an evaluation portion of a molded product was obtained as the minimum Vickers hardness H2.

[Visual Observation Evaluation]

Originally, electrodeposition coating is conducted after chemical conversion treatment. However, as a simplified evaluation technique, a lacquer spray was uniformly applied to the surface of a molded product, followed by visual observation. Then, the incidence of surface roughness and the degree of sharpness of an evaluation face were examined in accordance with the following criteria.

Further, as another parameter indicating the degree of excellence of surface properties, arithmetic average value of wave Ra was determined using laser microscope manufactured by Keyence Corporation. Measurement conditions were an evaluation length of 2.0 mm and a cutoff wavelength λc of 0.8 mm. Then, profiles on the short wavelength side of the cutoff wavelength λc were evaluated.

Evaluation criteria are as follows.

A: No pattern is confirmed by visual observation on the surface of an evaluation portion of the top panel of a molded product, and the surface is shiny and has excellent sharpness (Ra≤0.75 μm). The molded product is more desirable as an automobile exterior sheet part and can also be used as an exterior part of a luxury car.

B: No pattern is confirmed by visual observation on the surface of an evaluation portion of the top panel of a molded product, and the surface is shiny (0.75 μm<Ra≤0.90 μm). The molded product can be used as an automobile part.

C: The surface of the top panel of a molded product is not shiny (0.90 μm<Ra≤1.30 μm). The molded product cannot be used as an automobile exterior sheet part.

D: A pattern is confirmed by visual observation on the surface of an evaluation portion of the top panel of a molded product, and the surface is not shiny (1.30 μm<Ra). The molded product cannot be used as an automobile part.

TABLE 2

| Steel piece | Chemical composition % by mass (balance = Fe + impurities) | | | | | | | | | | | |
|---|---|---|---|---|---|---|---|---|---|---|---|---|
| No. | C | Si | Mn | P | S | Al | N | Ti | Nb | B | Cu | Sn |
| A | 0.0025 | 0.012 | 0.09 | 0.02 | 0.003 | 0.04 | 0.003 | 0.012 | 0.023 | 0.0007 | 0 | 0 |
| B | 0.0035 | 0.13 | 1.53 | 0.03 | 0.006 | 0.04 | 0.003 | 0.023 | 0 | 0.0005 | 0.04 | 0 |
| C | 0.0028 | 0.01 | 1.08 | 0.09 | 0.005 | 0.03 | 0.003 | 0.021 | 0.014 | 0.0003 | 0 | 0 |
| D | 0.0023 | 1.18 | 1.02 | 0.007 | 0.008 | 0.065 | 0.0019 | 0.066 | 0 | 0 | 0.15 | 0.04 |
| E | 0.0031 | 0.02 | 2.26 | 0.029 | 0.006 | 0.05 | 0.0019 | 0.055 | 0.003 | 0 | 0 | 0 |
| F | 0.0016 | 2.68 | 0.15 | 0.005 | 0.004 | 0.043 | 0.0028 | 0.02 | 0.015 | 0.0003 | 0 | 0 |
| G | 0.0012 | 0.05 | 0.22 | 0.013 | 0.007 | 0.031 | 0.0018 | 0.023 | 0.008 | 0.0001 | 0.02 | 0.0006 |
| H | 0.001 | 0.05 | 0.22 | 0.013 | 0.007 | 0.031 | 0.002 | 0.023 | 0.008 | 0 | 0 | 0 |
| I | 0.02 | 0.05 | 0.4 | 0.007 | 0.001 | 0.025 | 0.011 | 0.001 | 0.001 | 0 | 0 | 0 |
| J | 0.07 | 0.07 | 0.4 | 0.007 | 0.001 | 0.025 | 0.009 | 0.02 | 0.03 | 0 | 0 | 0 |
| K | 0.005 | 0.02 | 0.09 | 0.086 | 0.004 | 0.04 | 0.003 | 0.034 | 0.07 | 0.0007 | 0 | 0 |
| L | 0.005 | 0.02 | 0.9 | 0.086 | 0.004 | 0.04 | 0.003 | 0.034 | 0.07 | 0.0007 | 0 | 0 |
| M | 0.008 | 0.02 | 0.9 | 0.086 | 0.004 | 0.04 | 0.003 | 0.035 | 0.07 | 0.0005 | 0 | 0 |
| N | 0.01 | 0.02 | 0.9 | 0.086 | 0.004 | 0.04 | 0.003 | 0.035 | 0.07 | 0.0005 | 0 | 0 |
| O | 0.008 | 0.02 | 0.9 | 0.15 | 0.004 | 0.04 | 0.003 | 0.035 | 0.05 | 0.0005 | 0 | 0 |
| P | 0.005 | 0.02 | 1.5 | 0.08 | 0.004 | 0.045 | 0.004 | 0.05 | 0.025 | 0 | 0 | 0 |
| Q | 0.008 | 0.02 | 1.5 | 0.08 | 0.004 | 0.045 | 0.004 | 0.055 | 0.025 | 0.0002 | 0 | 0 |
| R | 0.01 | 0.02 | 1.5 | 0.08 | 0.004 | 0.045 | 0.004 | 0.06 | 0.025 | 0 | 0 | 0 |
| S | 0.008 | 0.02 | 2 | 0.08 | 0.004 | 0.045 | 0.004 | 0.045 | 0.025 | 0.0002 | 0 | 0 |
| T | 0.008 | 0.02 | 1.5 | 0.2 | 0.004 | 0.045 | 0.004 | 0.04 | 0.025 | 0.0002 | 0 | 0 |
| U | 0.008 | 0.02 | 2 | 0.2 | 0.004 | 0.045 | 0.004 | 0.05 | 0.025 | 0.0002 | 0 | 0 |
| V | 0.008 | 0.02 | 0.9 | 0.086 | 0.004 | 0.04 | 0.003 | 0.035 | 0.07 | 0.0005 | 0.01 | 0 |
| W | 0.008 | 0.02 | 0.9 | 0.086 | 0.004 | 0.04 | 0.003 | 0.035 | 0.07 | 0.0005 | 0 | 0.01 |
| X | 0.008 | 0.02 | 0.9 | 0.086 | 0.004 | 0.04 | 0.003 | 0.035 | 0.07 | 0.0005 | 0 | 0 |
| Y | 0.008 | 0.02 | 0.9 | 0.086 | 0.004 | 0.04 | 0.003 | 0.035 | 0.07 | 0.0005 | 0 | 0 |
| Z | 0.008 | 0.02 | 0.9 | 0.086 | 0.004 | 0.04 | 0.003 | 0.035 | 0.07 | 0.0005 | 0 | 0 |
| AA | 0.008 | 0.02 | 0.9 | 0.086 | 0.004 | 0.04 | 0.003 | 0.035 | 0.07 | 0.0005 | 0 | 0 |
| AB | 0.0371 | 0.01 | 0.19 | 0.01 | 0.005 | 0.029 | 0.0028 | 0.001 | 0 | 0.0001 | 0 | 0 |

| Steel piece | Chemical composition % by mass (balance = Fe + impurities) | | | | | | | | | Recrystallization |
|---|---|---|---|---|---|---|---|---|---|---|
| No. | Ni | Ca | Mg | As | Sb | Pb | REM | F1 | Ar3 | temperature ° C. |
| A | 0 | 0 | 0 | 0 | 0 | 0 | 0 | 1.04 | 932.5 | 740 |
| B | 0.02 | 0 | 0 | 0 | 0 | 0 | 0 | 1.45 | 904.1 | 730 |
| C | 0 | 0.001 | 0 | 0 | 0 | 0 | 0 | 1.03 | 950.7 | 768 |
| D | 0.08 | 0 | 0 | 0 | 0 | 0 | 0 | 0.42 | 979.7 | 781 |
| E | 0 | 0 | 0 | 0 | 0 | 0 | 0 | 0.49 | 894.1 | 748 |

TABLE 2-continued

| | | | | | | | | | | |
|---|---|---|---|---|---|---|---|---|---|---|
| F | 0 | 0 | 0.01 | 0.01 | 0 | 0 | 0 | 0.79 | 1046 | 870 |
| G | 0 | 0.0002 | 0 | 0 | 0.0007 | 0 | 0 | 0.79 | 929.3 | 730 |
| H | 0 | 0 | 0 | 0 | 0 | 0 | 0 | 0.79 | 929.9 | 735 |
| I | 0 | 0 | 0 | 0 | 0 | 0 | 0 | 78.63 | 886.8 | 725 |
| J | 0 | 0 | 0 | 0 | 0 | 0.001 | 0.05 | 8.80 | 870.3 | 721 |
| K | 0 | 0 | 0 | 0 | 0 | 0 | 0 | 0.517 | 983.6 | 770 |
| L | 0 | 0 | 0 | 0 | 0 | 0 | 0 | 0.517 | 959.3 | 762 |
| M | 0 | 0 | 0 | 0 | 0 | 0 | 0 | 0.679 | 955.9 | 760 |
| N | 0 | 0 | 0 | 0 | 0 | 0 | 0 | 0.791 | 953.8 | 775 |
| O | 0 | 0 | 0 | 0 | 0 | 0 | 0 | 0.794 | 1001 | 833 |
| P | 0 | 0 | 0 | 0 | 0 | 0 | 0 | 0.631 | 945.5 | 781 |
| Q | 0 | 0 | 0 | 0 | 0 | 0 | 0 | 0.762 | 943.7 | 779 |
| R | 0 | 0 | 0 | 0 | 0 | 0 | 0 | 0.819 | 943.6 | 779 |
| S | 0 | 0 | 0 | 0 | 0 | 0 | 0 | 0.893 | 924.7 | 764 |
| T | 0 | 0 | 0 | 0 | 0 | 0 | 0 | 0.978 | 1022 | 860 |
| U | 0 | 0 | 0 | 0 | 0 | 0 | 0 | 0.822 | 1011 | 854 |
| V | 0 | 0 | 0 | 0 | 0 | 0 | 0 | 0.679 | 955.9 | 765 |
| W | 0 | 0 | 0 | 0 | 0 | 0 | 0.01 | 0.679 | 955.9 | 764 |
| X | 0.01 | 0 | 0 | 0 | 0 | 0 | 0 | 0.679 | 955.9 | 765 |
| Y | 0 | 0.01 | 0 | 0 | 0 | 0 | 0.01 | 0.679 | 955.9 | 765 |
| Z | 0 | 0 | 0.01 | 0 | 0 | 0 | 0 | 0.679 | 955.9 | 766 |
| AA | 0 | 0 | 0 | 0.01 | 0.01 | 0.01 | 0.01 | 0.679 | 955.9 | 774 |
| AB | 0.01 | 0 | 0 | 0 | 0 | 0 | 0 | 165.5 | 884.6 | 715 |

TABLE 3

| | | | Hot rolling step | | Cooling step | | | |
|---|---|---|---|---|---|---|---|---|
| Steel sheet | Steel piece | Heating step Heating temperature ° C. | Draft for last two paths | Temperature for finishing rolling ° C. | Maximum cooling speed ° C./s | Time from completion of rolling to 650° C. s | Winding step Winding temperature ° C. | Cold rolling step Draft % |
| A1 | A | 1250 | 46%/47% | 925 | 300 | 1.5 | 680 | 75 |
| A2 | A | 1250 | 46%/47% | 925 | 300 | 1.5 | 680 | 75 |
| A3 | A | 1250 | 46%/47% | 940 | 300 | 1.5 | 680 | 75 |
| A4 | A | 1250 | 46%/47% | 940 | 300 | 1.5 | 680 | 75 |
| B | B | 1250 | 46%/47% | 910 | 100 | 2.5 | 580 | 78 |
| C | C | 1200 | 46%/47% | 901 | 100 | 2.5 | 630 | 70 |
| D | D | 1250 | 45%/45% | 910 | 300 | 1.5 | 700 | 68 |
| E | E | 1250 | 45%/45% | 910 | 300 | 1.5 | 700 | 68 |
| F | F | 1250 | 45%/45% | 910 | 300 | 1.5 | 700 | 68 |
| G | G | 1100 | 45%/45% | 930 | 100 | 4 | 580 | 75 |
| H | H | 1100 | 45%/45% | 930 | 100 | 4 | 580 | 75 |
| I | I | 1250 | 20%/16% | 922 | 300 | 1.5 | 332 | — |
| J | J | 1250 | 20%/16% | 915 | 300 | 1.5 | 411 | — |
| K1 | K | 1250 | 46%/47% | 910 | 300 | 1.5 | 680 | 75 |
| K2 | K | 1250 | 46%/47% | 910 | 300 | 1.5 | 680 | 75 |
| K3 | K | 1250 | 46%/47% | 935 | 300 | 1.5 | 680 | 75 |
| L | L | 1250 | 46%/47% | 935 | 300 | 1.5 | 680 | 75 |
| M1 | M | 1250 | 46%/47% | 910 | 300 | 1.5 | 680 | 75 |
| M2 | M | 1250 | 46%/47% | 910 | 300 | 1.5 | 680 | 75 |
| M3 | M | 1250 | 46%/47% | 910 | 300 | 1.5 | 680 | 75 |
| M4 | M | 1250 | 46%/47% | 935 | 300 | 1.5 | 680 | 75 |
| M5 | M | 1250 | 46%/47% | 935 | 300 | 1.5 | 680 | 75 |
| N | N | 1250 | 46%/47% | 935 | 300 | 1.5 | 680 | 75 |
| O | O | 1250 | 46%/47% | 935 | 300 | 1.5 | 680 | 75 |
| P | P | 1250 | 46%/47% | 900 | 300 | 1.5 | 660 | 75 |
| Q1 | Q | 1250 | 46%/47% | 900 | 300 | 1.5 | 650 | 75 |
| Q2 | Q | 1250 | 46%/47% | 900 | 300 | 1.5 | 670 | 75 |
| Q3 | Q | 1250 | 46%/47% | 930 | 300 | 1.5 | 660 | 75 |
| Q4 | Q | 1250 | 46%/47% | 930 | 300 | 1.5 | 670 | 75 |
| Q5 | Q | 1250 | 46%/47% | 930 | 300 | 1.5 | 670 | 75 |
| R | R | 1250 | 46%/47% | 900 | 300 | 1.5 | 670 | 75 |
| S | S | 1250 | 46%/47% | 900 | 300 | 1.5 | 670 | 75 |
| T | T | 1250 | 46%/47% | 900 | 300 | 1.5 | 670 | 75 |
| U | U | 1250 | 46%/47% | 900 | 300 | 1.5 | 670 | 75 |
| V | V | 1250 | 46%/47% | 910 | 300 | 1.5 | 670 | 75 |
| W | W | 1250 | 46%/47% | 910 | 300 | 1.5 | 670 | 75 |
| X | X | 1250 | 46%/47% | 910 | 300 | 1.5 | 670 | 75 |
| Y | Y | 1250 | 46%/47% | 910 | 300 | 1.5 | 670 | 75 |
| Z | Z | 1250 | 46%/47% | 910 | 300 | 1.5 | 670 | 75 |
| AA | AA | 1250 | 46%/47% | 910 | 300 | 1.5 | 670 | 75 |
| AB | AB | 1250 | 46%/47% | 910 | 300 | 1.5 | 670 | 75 |

TABLE 4

| Steel sheet | Recrystallization temperature ° C. | Annealing step: Annealing temperature ° C. | Annealing step: Annealing time s | Annealing step: Heating method | Unevenness of temperature in surface of sheet ° C. | Plate thickness mm | Crystal grain A: Area fraction % | Crystal grain A: Average crystal grain size μm | Crystal grain C1 Area fraction % |
|---|---|---|---|---|---|---|---|---|---|
| A1 | 740 | 790 | 60 | Gas furnace | ±30 | 0.75 | 17.9 | 14.8 | 17.7 |
| A2 | 740 | 775 | 60 | Gas furnace | ±30 | 0.75 | 17.4 | 13.4 | 15.4 |
| A3 | 740 | 775 | 60 | Gas furnace | ±30 | 0.75 | 14.1 | 17.1 | 12.5 |
| A4 | 740 | 790 | 120 | Gas furnace | ±10 | 0.75 | 17.9 | 15.9 | 17.5 |
| B | 730 | 850 | 60 | Gas furnace | ±30 | 0.75 | 12.8 | 18.1 | 11.4 |
| C | 768 | 870 | 60 | Gas furnace | ±30 | 0.85 | 11.4 | 17.4 | 10.5 |
| D | 781 | 840 | 60 | Gas furnace | ±30 | 0.9 | 94 | 12.2 | 8.8 |
| E | 748 | 800 | 60 | Gas furnace | ±30 | 0.9 | 12.5 | 10.5 | 11.4 |
| F | 870 | 1000 | 60 | Gas furnace | ±40 | 0.9 | 54.5 | 14.4 | 50.1 |
| G | 730 | 830 | 60 | Gas furnace | ±30 | 0.75 | 12.1 | 16.5 | 11.3 |
| H | 735 | 830 | 60 | Gas furnace | ±30 | 0.75 | 11.1 | 16.5 | 10.3 |
| I | 725 | — | — | — | — | 4 | 61.2 | 29 | 55.8 |
| J | 721 | — | — | — | — | 4 | 60.2 | 23 | 57.1 |
| K1 | 770 | 790 | 60 | Gas furnace | ±30 | 0.75 | 17.9 | 14.9 | 17.3 |
| K2 | 770 | 800 | 60 | Gas furnace | ±30 | 0.75 | 15.9 | 15.9 | 15.3 |
| K3 | 770 | 800 | 120 | Gas furnace | ±15 | 0.75 | 12.8 | 18.4 | 17.7 |
| L | 762 | 775 | 60 | Near-infrared heating furnace | ±10 | 0.75 | 27.6 | 15.9 | 19.1 |
| M1 | 760 | 770 | 60 | Near-infrared heating furnace | ±10 | 0.75 | 17.4 | 18.3 | 20.2 |
| M2 | 760 | 770 | 90 | Near-infrared heating furnace | ±10 | 0.75 | 15.1 | 19.1 | 18.2 |
| M3 | 760 | 780 | 60 | Near-infrared heating furnace | ±10 | 0.75 | 16.4 | 18.8 | 18.5 |
| M4 | 760 | 780 | 60 | Gas furnace | ±30 | 0.75 | 17.9 | 15.1 | 17.3 |
| M5 | 760 | 770 | 60 | Near-infrared heating furnace | ±10 | 0.75 | 18.3 | 17.4 | 19.5 |
| N | 775 | 785 | 60 | Near-infrared heating furnace | ±10 | 0.75 | 26.8 | 12.8 | 28.7 |
| O | 833 | 840 | 60 | Near-infrared heating furnace | ±10 | 0.75 | 25.6 | 11.5 | 31.1 |
| P | 781 | 790 | 60 | Near-infrared heating furnace | ±10 | 0.75 | 25.1 | 13.4 | 19 |
| Q1 | 779 | 785 | 60 | Near-infrared heating furnace | ±10 | 0.75 | 26.2 | 13 | 18.5 |
| Q2 | 779 | 800 | 60 | Near-infrared heating furnace | ±10 | 0.75 | 28.1 | 16.4 | 20.5 |
| Q3 | 779 | 795 | 60 | Near-infrared heating furnace | ±10 | 0.75 | 25.8 | 10.5 | 30.8 |
| Q4 | 779 | 795 | 120 | Near-infrared heating furnace | ±10 | 0.75 | 24.8 | 13.1 | 17.5 |
| Q5 | 779 | 775 | 60 | Near-infrared heating furnace | ±10 | 0.75 | 24.5 | 15.9 | 17.9 |
| R | 779 | 790 | 60 | Near-infrared heating furnace | ±10 | 0.75 | 33.4 | 11.1 | 35.1 |
| S | 764 | 770 | 60 | Near-infrared heating furnace | ±10 | 0.75 | 25.8 | 10.4 | 30.9 |
| T | 860 | 870 | 60 | Near-infrared heating furnace | ±10 | 0.75 | 28 | 13.6 | 27.2 |
| U | 854 | 860 | 60 | Near-infrared heating furnace | ±10 | 0.75 | 36.3 | 14.5 | 29.8 |
| V | 765 | 770 | 60 | Near-infrared heating furnace | ±10 | 0.75 | 17.4 | 18 | 18.4 |
| W | 764 | 770 | 60 | Near-infrared heating furnace | ±10 | 0.75 | 16.4 | 17.6 | 19.2 |
| X | 765 | 770 | 60 | Near-infrared heating furnace | ±10 | 0.75 | 16.3 | 17.8 | 18.1 |
| Y | 765 | 770 | 60 | Near-infrared heating furnace | ±10 | 0.75 | 16.5 | 17.4 | 18 |
| Z | 766 | 770 | 60 | Near-infrared heating furnace | ±10 | 0.75 | 16.8 | 17.5 | 18.7 |
| AA | 774 | 770 | 60 | Near-infrared heating furnace | ±10 | 0.75 | 15.8 | 17.5 | 20.2 |
| AB | 715 | 730 | 60 | Near-infrared heating furnace | ±10 | 1.2 | 44.8 | 10.8 | 42.5 |

TABLE 5

| | Molding conditions | | | Molded product | | | | | | | | | |
|---|---|---|---|---|---|---|---|---|---|---|---|---|---|
| Molded product No. | Steel sheet No. | Evaluation portion Sheet thickness decrease rate [%] | Deformation ratio β | Crystal grain C2 Area fraction % | Maximum thickness D1 [mm] | Minimum thickness D2 [mm] | (D1 − D2)/D1 × 100 | Maximum hardness H1 [MPa] | Minimum hardness H2 [MPa] | (H1 − H2)/H1 × 100 | $R_a$ [μm] | Visual observation evaluation | note |
| 1A | A3 | 8 | 0 | 12.5 | 0.76 | 0.69 | 9.2 | 111 | 96 | 13.5 | 1.03 | C | Reference Example |
| 2A | A3 | 16 | 0 | 12.7 | 0.77 | 0.63 | 18.2 | 124 | 97 | 21.7 | 1.12 | C | Comparative Example |
| 3A | A3 | 25 | 0 | 13 | 0.78 | 0.56 | 28.2 | 137 | 97 | 29.4 | 1.33 | D | Comparative Example |
| 4A | A3 | 8 | 1 | 12.3 | 0.76 | 0.69 | 9.2 | 111 | 96 | 13.5 | 0.88 | B | Reference Example |
| 5A | A3 | 16 | 1 | 12.1 | 0.77 | 0.63 | 18.2 | 124 | 97 | 21.7 | 0.92 | C | Comparative Example |
| 6A | A3 | 25 | 1 | 11.9 | 0.78 | 0.56 | 28.2 | 137 | 97 | 29.4 | 1.11 | C | Comparative Example |
| 7A | K3 | 8 | 0 | 17.7 | 0.76 | 0.69 | 9.2 | 140 | 121 | 13.6 | 1.11 | C | Reference Example |
| 8A | K3 | 16 | 0 | 17.8 | 0.77 | 0.63 | 18.2 | 156 | 122 | 21.8 | 1.31 | D | Comparative Example |
| 9A | K3 | 25 | 0 | 17.9 | 0.78 | 0.56 | 28.2 | 173 | 122 | 29.5 | 1.54 | D | Comparative Example |
| 10A | K3 | 8 | 1 | 17.5 | 0.76 | 0.69 | 9.2 | 140 | 121 | 13.6 | 0.95 | C | Comparative Example |
| 11A | K3 | 16 | 1 | 17.3 | 0.77 | 0.63 | 18.2 | 156 | 122 | 21.8 | 0.99 | C | Comparative Example |
| 12A | K3 | 25 | 1 | 17.1 | 0.78 | 0.56 | 28.2 | 173 | 122 | 29.5 | 1.19 | C | Comparative Example |
| 13A | M5 | 8 | 0 | 19.5 | 0.76 | 0.69 | 9.2 | 161 | 139 | 13.6 | 0.66 | A | Reference Example |
| 14A | M5 | 16 | 0 | 19.9 | 0.77 | 0.63 | 18.2 | 179 | 140 | 21.8 | 0.73 | A | Example |
| 15A | M5 | 25 | 0 | 20.5 | 0.78 | 0.56 | 28.2 | 196 | 138 | 29.5 | 0.85 | B | Example |
| 16A | M5 | 8 | 1 | 19.2 | 0.76 | 0.69 | 9.2 | 159 | 137 | 13.6 | 0.68 | A | Reference Example |
| 17A | M5 | 16 | 1 | 18.7 | 0.77 | 0.63 | 18.2 | 179 | 140 | 21.8 | 0.71 | A | Example |
| 18A | M5 | 25 | 1 | 18.3 | 0.78 | 0.56 | 28.2 | 201 | 142 | 29.5 | 0.81 | B | Example |
| 19A | Q3 | 8 | 0 | 30.8 | 0.76 | 0.69 | 9.2 | 174 | 150 | 13.6 | 0.67 | A | Reference Example |
| 20A | Q3 | 16 | 0 | 31.7 | 0.77 | 0.63 | 18.2 | 194 | 152 | 21.8 | 0.77 | B | Example |
| 21A | Q3 | 25 | 0 | 35 | 0.78 | 0.56 | 28.2 | 214 | 151 | 29.5 | 0.89 | B | Example |
| 22A | Q3 | 8 | 1 | 30.3 | 0.76 | 0.69 | 9.2 | 172 | 149 | 13.6 | 0.66 | A | Reference Example |
| 23A | Q3 | 16 | 1 | 28.8 | 0.77 | 0.63 | 18.2 | 191 | 149 | 21.8 | 0.78 | B | Example |
| 24A | Q3 | 25 | 1 | 27.2 | 0.78 | 0.56 | 28.2 | 216 | 152 | 29.5 | 0.89 | B | Example |
| 25A | AB | 8 | 0 | 42.5 | 1.22 | 1.10 | 9.2 | 139 | 120 | 13.6 | 0.91 | C | Reference Example |
| 26A | AB | 16 | 0 | 42.7 | 1.23 | 1.01 | 18.2 | 151 | 118 | 21.8 | 1.21 | C | Comparative Example |
| 27A | AB | 25 | 0 | 43 | 1.25 | 0.90 | 28.2 | 164 | 116 | 29.5 | 1.61 | D | Comparative Example |
| 28A | AB | 8 | 1 | 42.3 | 1.22 | 1.10 | 9.2 | 138 | 119 | 13.6 | 0.84 | B | Reference Example |
| 29A | AB | 16 | 1 | 42.1 | 1.23 | 1.01 | 18.2 | 150 | 117 | 21.8 | 1.12 | C | Comparative Example |
| 30A | AB | 25 | 1 | 41.9 | 1.25 | 0.90 | 28.2 | 170 | 120 | 29.5 | 1.24 | C | Comparative Example |

The above results show that surface roughness of the molded product corresponding to Examples is inhibited compared to the molded product corresponding to Comparable Examples.

Example B

[Molding Simulation of Molded Product]

A cross-section of a metal sheet having a bcc structure used in Reference Example A was used to model crystal grains in a cross-section of a metal sheet having an fcc structure. Then, while changing the grain size of the crystal grains in the cross-section of the metal sheet having the fcc structure, the average area fractions of crystal grains A and crystal grains B were changed to model a virtual material having properties listed in Table 6.

Next, a molding simulation corresponding to molding (the same molding of a molded product as in Example A) shown in FIG. 7 by drawing and stretching was performed on the modeled virtual material. In other words, a molding simulation was performed on the modeled virtual material to assign a "sheet thickness decrease rate" corresponding to the amount of plastic strain of a virtual material, which is an evaluation portion (a bending exterior of the minimum radius of curvature of a ridge line in a cross-section orthogonal to an extensional direction of the ridge line) of a molded product.

Specifically, first, a press molding simulation (hereinafter, referred to as "press molding simulation") of a model shape was performed using the finite element analysis method in order to impart a displacement resulting in an "equivalent plastic strain" as listed in Table 6 to the virtual material.

The maximum sheet thickness D1 (corresponding to the maximum sheet thickness D1 of the molded product), the minimum sheet thickness D2 (corresponding to the minimum sheet thickness D2 of the molded product), the maximum Vickers hardness H1 (corresponding to the maximum Vickers hardness H1 of the molded product), and the minimum Vickers hardness H2 (corresponding to the minimum Vickers hardness H2 of the molded product) in the virtual material after performing the press molding simulation were then calculated.

As the molding simulation of a virtual material corresponding to this press molding simulation, a molding simulation (hereinafter, referred to as "molding simulation") in which a displacement of "equivalent plastic strain" listed in Table 6 was imparted to the left, right, front, and depth directions of a cross-section of a virtual material to cause biaxial tensile deformation was performed by the crystal plasticity finite element analysis.

The maximum sheet thickness D1 (corresponding to the maximum sheet thickness D1 of the molded product) and the minimum sheet thickness D2 (corresponding to the minimum sheet thickness D2 of the molded product) in the virtual material after the above-described press molding simulation were determined as follows.

The maximum sheet thickness D1 is the thickness of a press molded product at a location where the sheet thickness is at its maximum in the plate surface.

The minimum sheet thickness D2 is the thickness of a press molded product at a location where the sheet thickness is at its minimum in the plate surface.

The maximum Vickers hardness H1 (corresponding to the maximum Vickers hardness H1 of the molded product) and the minimum Vickers hardness H2 (corresponding to the minimum Vickers hardness H2 of the molded product) in the virtual material after performing the above-described press molding simulation were as follows.

For the maximum Vickers hardness H1, the Vickers hardness before molding was calculated from the average yield strength $YP_1$ (MPa) of the virtual material using the following formula.

$$\text{maximum Vickers hardness } H1 = YP_1 \text{ (MPa)}/3 \qquad \text{Formula}$$

For the minimum Vickers hardness H2, the Vickers hardness after molding (after work hardening) was calculated from the average yield strength $YP_2$ (MPa) of the above-described virtual material using the following formula.

$$\text{maximum Vickers hardness } H2 = YP_2 \text{ (MPa)}/3 \qquad \text{Formula}$$

However, for Vickers hardness before molding, the average yield strength $YP_1$ (MPa) of a virtual material was calculated based on the yield strength and its crystal orientation dependence of 6000 series aluminum alloy sheet as the virtual material.

For Vickers hardness after molding (after work hardening), the average yield strength $YP_2$ (MPa) of the virtual material was calculated using an equivalent stress value at a location where the sheet thickness is minimum in the sheet surface of the above-described press molded product based on the above-described press molding simulation into which the mechanical properties of 6000 series aluminum alloy sheet were input.

The following evaluation was implemented about the virtual material after performing the above-described molding simulation. The results are listed in Table 6.

An example of a molding simulation condition in which the sheet thickness decrease rate is less than 10% is an example in which the amount of strain is small and no surface unevenness occurs, and is therefore described as Reference Example.

(Unevenness Height)

For the virtual material after performing the above-described molding simulation, the height of unevenness on the surface was calculated by the following method. The surface profile of the virtual material after performing the molding simulation was used as the cross-sectional curve of the virtual material, and the unevenness height of the surface was calculated from the maximum value and the minimum value of the cross-sectional curve.

(Arithmetic Mean Height Pa of Cross-sectional Curve)

For the surface properties of the virtual material after performing the molding simulation, the cross-sectional curve of the virtual material was obtained, and then the arithmetic mean height Pa of the cross-sectional curve was calculated. The surface properties were then evaluated by the following evaluation criteria.

The arithmetic mean height Pa of the cross-sectional curve is the arithmetic mean height defined in JIS B0601 (2001). The measurement conditions are as follows.

Evaluation length: 1 mm

Standard length: 1 mm

The evaluation criteria of the surface properties of the virtual material are as follows.

A: Pa≤0.75 μm (The material is more desirable as an automobile exterior sheet part and can also be used as an exterior part of a luxury car.)

B: 0.75 μm<Pa≤0.95 μm (The material can be used as an automobile part.)

C: 0.95 μm<Pa≤1.30 μm (The material cannot be used as an automobile exterior sheet part.)

D: 1.30 μm<Pa (The material cannot be used as an automobile part.)

TABLE 6

| | Molding simulation condition | | Virtual material having fcc structure | | | Virtual material after press-molding simulation | | | | | | | | | |
|---|---|---|---|---|---|---|---|---|---|---|---|---|---|---|---|
| | Evaluation portion | | | Crystal grain A | | | | | | | | | | | |
| Molded product No. | Sheet thickness decrease rate [%] | Deformation ratio β | Crystal grain A Area fraction % | Average crystal grain size μm | Crystal grain C1 Area fraction % | Crystal grain C2 Area fraction % | Maximum thickness D1 [mm] | Minimum thickness D2 [mm] | (D1 − D2)/D1 × 100 | Assumed maximum hardness H1 [mm] | Assumed minimum hardness H2 [mm] | (H1 − H2)/H1 × 100 | Pa [μm] | Pa evaluation | Remarks |
| 1B | 8 | 0 | 14 | 15 | 12.5 | 12.5 | 0.76 | 0.73 | 4.6 | 96 | 82 | 15.3 | 0.93 | B | Reference Example |
| 2B | 16 | 0 | 14 | 15 | 12.5 | 12.7 | 0.77 | 0.70 | 9.1 | 103 | 82 | 20.1 | 1.00 | C | Comparative Example |
| 3B | 25 | 0 | 14 | 15 | 12.5 | 13 | 0.78 | 0.67 | 14.1 | 110 | 82 | 25.0 | 1.51 | D | Comparative Example |
| 4B | 8 | 1 | 14 | 15 | 12.5 | 12.3 | 0.76 | 0.73 | 4.6 | 96 | 82 | 15.3 | 0.80 | B | Reference Example |
| 5B | 25 | 1 | 14 | 15 | 12.5 | 11.9 | 0.78 | 0.67 | 14.1 | 110 | 82 | 25.0 | 0.99 | C | Comparative Example |
| 6B | 8 | 0 | 31 | 15 | 35.5 | 30.8 | 0.76 | 0.73 | 4.6 | 151 | 128 | 15.3 | 0.63 | A | Reference Example |
| 7B | 25 | 0 | 31 | 15 | 35.5 | 35 | 0.78 | 0.67 | 14.1 | 171 | 128 | 25.0 | 0.81 | B | Example |
| 8B | 8 | 1 | 31 | 15 | 35.5 | 30.3 | 0.76 | 0.73 | 4.6 | 150 | 127 | 15.3 | 0.62 | A | Reference Example |
| 9B | 25 | 1 | 31 | 15 | 35.5 | 27.2 | 0.78 | 0.67 | 14.1 | 172 | 129 | 25.0 | 0.81 | B | Example |
| 10B | 8 | 0 | 18 | 15 | 19.5 | 19.5 | 0.76 | 0.73 | 4.6 | 139 | 118 | 15.3 | 0.62 | A | Reference Example |
| 11B | 16 | 0 | 18 | 15 | 19.5 | 19.9 | 0.77 | 0.70 | 9.1 | 149 | 119 | 20.1 | 0.68 | A | Example |
| 12B | 25 | 0 | 18 | 15 | 19.5 | 20.5 | 0.78 | 0.67 | 14.1 | 156 | 117 | 25.0 | 0.78 | B | Example |
| 13B | 8 | 1 | 18 | 15 | 19.5 | 19.2 | 0.76 | 0.73 | 4.6 | 137 | 116 | 15.3 | 0.50 | A | Reference Example |
| 14B | 16 | 1 | 18 | 15 | 19.5 | 18.8 | 0.77 | 0.70 | 9.1 | 149 | 119 | 20.1 | 0.59 | A | Example |
| 15B | 25 | 1 | 18 | 15 | 19.5 | 18.3 | 0.78 | 0.67 | 14.1 | 161 | 121 | 25.0 | 0.74 | A | Example |
| 16B | 16 | 0 | 14 | 17 | 12.5 | 12.7 | 0.77 | 0.70 | 9.1 | 103 | 82 | 20.1 | 1.30 | D | Comparative Example |
| 17B | 25 | 0 | 14 | 17 | 12.5 | 13 | 0.78 | 0.67 | 14.1 | 110 | 82 | 25.0 | 1.85 | D | Comparative Example |
| 18B | 8 | 1 | 14 | 17 | 12.5 | 12.3 | 0.76 | 0.73 | 4.6 | 96 | 82 | 15.3 | 0.80 | B | Reference Example |
| 19B | 16 | 1 | 14 | 17 | 12.5 | 12.1 | 0.77 | 0.70 | 9.1 | 103 | 82 | 20.1 | 1.05 | C | Comparative Example |
| 20B | 25 | 1 | 14 | 17 | 12.5 | 11.9 | 0.78 | 0.67 | 14.1 | 110 | 82 | 25.0 | 1.33 | D | Comparative Example |
| 21B | 8 | 0 | 26 | 17 | 30.5 | 30.8 | 0.76 | 0.73 | 4.6 | 151 | 128 | 15.3 | 0.44 | A | Reference Example |
| 22B | 16 | 0 | 26 | 17 | 30.5 | 31.7 | 0.77 | 0.70 | 9.1 | 162 | 129 | 20.1 | 0.73 | A | Example |
| 23B | 25 | 0 | 26 | 17 | 30.5 | 35 | 0.78 | 0.67 | 14.1 | 171 | 128 | 25.0 | 0.89 | B | Example |
| 24B | 8 | 1 | 26 | 17 | 30.5 | 30.3 | 0.76 | 0.73 | 4.6 | 150 | 127 | 15.3 | 0.41 | A | Reference Example |
| 25B | 16 | 1 | 26 | 17 | 30.5 | 28.8 | 0.77 | 0.70 | 9.1 | 159 | 127 | 20.1 | 0.55 | A | Example |
| 26B | 25 | 1 | 26 | 17 | 30.5 | 27.2 | 0.78 | 0.67 | 14.1 | 172 | 129 | 25.0 | 0.76 | B | Example |
| 27B | 8 | 0 | 18 | 17 | 26.5 | 25.8 | 0.76 | 0.73 | 4.6 | 139 | 118 | 15.3 | 0.44 | A | Reference Example |
| 28B | 16 | 0 | 18 | 17 | 19.5 | 19.9 | 0.77 | 0.70 | 9.1 | 149 | 119 | 20.1 | 0.55 | A | Example |
| 29B | 25 | 0 | 18 | 17 | 19.5 | 20.5 | 0.78 | 0.67 | 14.1 | 156 | 117 | 25.0 | 0.66 | A | Example |
| 30B | 8 | 1 | 18 | 17 | 19.5 | 19.2 | 0.76 | 0.73 | 4.6 | 137 | 116 | 15.3 | 0.44 | A | Reference Example |
| 31B | 16 | 1 | 18 | 17 | 19.5 | 18.7 | 0.77 | 0.70 | 9.1 | 149 | 119 | 20.1 | 0.56 | A | Example |
| 32B | 25 | 1 | 18 | 17 | 19.5 | 18.3 | 0.78 | 0.67 | 14.1 | 161 | 121 | 25.0 | 0.68 | A | Example |

From the above results, it can be seen that surface roughness of the molded product according to Examples is inhibited compared to the molded product according to the Comparative Examples.

As described above, a molding simulation involving plane strain tensile deformation and biaxial deformation was performed on a virtual material having an fcc structure, and the results show that the surface roughness of the molded product is inhibited in the same manner as on a steel sheet having a bcc structure.

The description of the symbols is as follows.

10 Molded product of metal sheet
11 Metal sheet
12 Ridge line of molded product of metal sheet
14 Top panel of molded product of metal sheet
14A Shoulder of molded product of metal sheet along extension direction of ridge line
14B Shoulder of molded product of metal sheet intersecting extension direction of ridge line
16 wall of molded product of metal sheet
16A wall of molded product of metal sheet along extension direction of ridge line
16B wall of molded product of metal sheet intersecting extension direction of ridge line
18 Flange of molded product of metal sheet
18A Flange of molded product of metal sheet in direction orthogonal to ridge line
18B Flange of molded product of metal sheet in extension direction of ridge line The disclosure of Japanese Patent Application Laid-Open (JP-A) No. 2018-071080 cited in the present description are incorporated herein by reference in their entirety.

All publications, patent applications, and technical standards described herein are incorporated herein by reference in their entirety to the same extent as if the publications, patent applications, and technical standards have been written specifically and individually to be incorporated by reference.

The invention claimed is:

1. A metal sheet having a bcc structure and satisfying the following condition (a1) or (b1) at a surface thereof:

(a1) an area fraction of crystal grains having a crystal orientation divergent by 20° or more from a (111) plane parallel to a surface of the metal sheet and by 20° or more from a (001) plane is from 0.25 to 0.35, and an average crystal grain size is less than 16 μm; or (b1) an area fraction of crystal grains having a crystal orientation divergent by 20° or more from a (111) plane parallel to a surface of the metal sheet and by 20° or more from a (001) plane is from 0.15 to 0.30, and an average crystal grain size is 16 μm or more, wherein the metal sheet is a steel sheet;

wherein the steel sheet is a ferrite-based steel sheet having a chemical composition of:

C: from 0.0040% by mass to 0.0100% by mass;
Si: from 0% by mass to 1.0% by mass;
Mn: from 0.90% by mass to 2.00% by mass;
P: from 0.050% by mass to 0.200% by mass;
S: from 0% by mass to 0.010% by mass;
Al: from 0.00050% to 0.10% by mass;
N: from 0% by mass to 0.0040% by mass;
Ti: from 0.0010% by mass to 0.10% by mass;
Nb: from 0.0010% by mass to 0.10% by mass;
B: from 0% by mass to 0.003% by mass;
a total of one or more of Cu or Sn: from 0% by mass to 0.10% by mass;
a total of one or more of Ni, Ca, Mg, Y, As, Sb, Pb, or REM: from 0% by mass to 0.10% by mass; and
a balance: Fe and impurities, wherein a value of F1 as defined in the following Formula (1) is from 0.5 to 1.0:

$$F1=(C/12+N/14+S/32)/(Ti/48+Nb/93) \quad \text{Formula (1).}$$

2. The metal sheet according to claim 1, wherein the steel sheet is the ferrite-based steel sheet having a ferrite fraction of 50% or more of a metallic structure at a surface thereof.

3. The metal sheet according to claim 1, wherein the chemical composition of the steel sheet contains one or two or more of:

the total of one or more of Cu or Sn: from 0.002% by mass to 0.10% by mass; and
the total of one or more of Ni, Ca, Mg, Y, As, Sb, Pb, or REM: from 0.005% by mass to 0.10% by mass.

4. A method of producing the metal sheet according to claim 3, the method comprising:

cold-rolling a hot-rolled sheet with a draft of 70% or more to obtain a cold-rolled sheet; and
annealing the cold-rolled sheet under conditions of an annealing temperature of a recrystallization temperature or more and the recrystallization temperature +25° C. or less, a temperature irregularity at the sheet surface of ±10° C. or less, and an annealing time of 100 seconds or less;
thereby producing the metal sheet of claim 3.

5. A method of producing the metal sheet according to claim 1, the method comprising:

cold-rolling a hot-rolled sheet with a draft of 70% or more to obtain a cold-rolled sheet; and
annealing the cold-rolled sheet under conditions of an annealing temperature of a recrystallization temperature or more and the recrystallization temperature +25° C. or less, a temperature irregularity at the sheet surface of ±10° C. or less, and an annealing time of 100 seconds or less;
thereby producing the metal sheet of claim 1.

6. A metal sheet having a bcc structure and satisfying the following condition (c1) at a surface thereof:

(c1) an area fraction of crystal grains with a Taylor Factor value from 3.0 to 3.4, when assuming plane strain tensile deformation in a transverse direction in a plane of the metal sheet, is from 0.18 to 0.40, wherein the metal sheet is a steel sheet;

wherein the steel sheet is a ferrite-based steel sheet having a chemical composition of:

C: from 0.0040% by mass to 0.0100% by mass;
Si: from 0% by mass to 1.0% by mass;
Mn: from 0.90% by mass to 2.00% by mass;
P: from 0.050% by mass to 0.200% by mass;
S: from 0% by mass to 0.010% by mass;
Al: from 0.00050% to 0.10% by mass;
N: from 0% by mass to 0.0040% by mass;
Ti: from 0.0010% by mass to 0.10% by mass;
Nb: from 0.0010% by mass to 0.10% by mass;
B: from 0% by mass to 0.003% by mass;
a total of one or more of Cu or Sn: from 0% by mass to 0.10% by mass;
a total of one or more of Ni, Ca, Mg, Y, As, Sb, Pb, or REM: from 0% by mass to 0.10% by mass; and
a balance: Fe and impurities, wherein a value of F1 as defined in the following Formula (1) is from 0.5 to 1.0:

$$F1=(C/12+N/14+S/32)/(Ti/48+Nb/93) \quad \text{Formula (1).}$$

7. The metal sheet according to claim 6, wherein the steel sheet is the ferrite-based steel sheet having a ferrite fraction of 50% or more of a metallic structure at a surface thereof.

8. The metal sheet according to claim 6, wherein the chemical composition of the steel sheet contains one or two or more of:

the total of one or more of Cu or Sn: from 0.002% by mass to 0.10% by mass; and the total of one or more of Ni, Ca, Mg, Y, As, Sb, Pb, or REM: from 0.005% by mass to 0.10% by mass.

9. A method of producing the metal sheet according to claim 6, the method comprising:

cold-rolling a hot-rolled sheet with a draft of 70% or more to obtain a cold-roiled sheet; and annealing the cold-rolled sheet under conditions of an annealing temperature of a recrystallization temperature or more and the recrystallization temperature +25° C. or less, a temperature irregularity at the sheet surface of ±10° C. or less, and an annealing time of 100 seconds or less;

thereby producing the metal sheet of claim 6.

* * * * *